United States Patent [19]

Ishikawa et al.

[11] Patent Number: 4,838,534

[45] Date of Patent: Jun. 13, 1989

[54] PAPER FEED APPARATUS

[75] Inventors: Tadashi Ishikawa, Urawa; Yutaka Kikuchi, Tokyo, both of Japan

[73] Assignee: Canon Kabushiki Kaisha, Tokyo, Japan

[21] Appl. No.: 186,670

[22] Filed: Apr. 20, 1988

Related U.S. Application Data

[63] Continuation of Ser. No. 933,368, Nov. 18, 1986, abandoned, which is a continuation of Ser. No. 542,728, Oct. 17, 1983, abandoned.

[30] Foreign Application Priority Data

Oct. 25, 1982 [JP] Japan ..... 57-185961
Oct. 25, 1982 [JP] Japan ..... 57-185962

[51] Int. Cl.[4] ..... B65H 5/06

[52] U.S. Cl. ..... 271/10; 271/259; 271/265; 271/111

[58] Field of Search ..... 271/10, 258, 259, 265, 271/110, 111

[56] References Cited

U.S. PATENT DOCUMENTS 3,415,510 12/1968 Mileski ..... 271/162
3,469,834 9/1969 Stange et al. ..... 271/10
4,639,959 1/1983 Hornbuckle ..... 271/151 X

FOREIGN PATENT DOCUMENTS 1611374 12/1970 Fed. Rep. of Germany .
0017960 1/1982 Japan .
0077140 5/1982 Japan ..... 271/9
0112247 7/1982 Japan .
0047732 3/1983 Japan ..... 271/9

*Primary Examiner*—Richard A. Schacher
*Attorney, Agent, or Firm*—Fitzpatrick, Cella, Harper & Scinto

[57] ABSTRACT

The present invention relates to a paper feed apparatus usable in the paper-containing cassette of an image forming system such as an electronic or electrostatic copying machine, a simple printing machine or the like. The paper feed apparatus according to the present invention includes a table on which a stack of cut sheets is supported, a cut-sheet conveying section insertable into a cut-sheet entrance in the image forming system, a paper feed mechanism for feeding the cut sheets from the table one by one, a cut-sheet conveying mechanism in the cut-sheet conveying section for receiving the cut sheet fed from the table and conveying it to a predetermined position in the cut-sheet conveying section wherein the cut sheet is once caused to stop and wait, and a sensor for detecting that the cut sheet has been fed out of the cut-sheet conveying section, so that the cut sheets can automatically be fed from the table to the cut-sheet conveying section one by one at each time that the previous cut sheet has been fed out of the cut-sheet conveying section.

7 Claims, 23 Drawing Sheets

PAPER FEED APPARATUS

This application is a continuation of application Ser. No. 933,368 filed Nov. 18, 1986, now abandoned, which in turn was a continuation application of Ser. No. 542,728 filed Oct. 17, 1983, now abandoned.

BACKGROUND OF THE INVENTION

1. Field of the Invention

The present invention relates to a paper feed apparatus for use in an image forming apparatus or the like. More particularly, the present invention relates to a paper feed apparatus usable with an image forming apparatus such as an electronic or electrostatic copying machine, a simple printing machine or the like, which is provided with a cassette type paper feeder.

In such a paper feed device for the papercontaining cassette, the cassette, which is pre-loaded with a stack of cut paper sheets, is inserted into the cassette receiving opening in the apparatus body. The cut sheets are fed from the cassette into an image formation section in the apparatus one by one under the action of paper feed means which is provided in the apparatus. By preparing a plurality of cassettes which contain the respective stacks of cut sheets different from one another in size and material, one cassette can manually and simply be replaced by another cassette so that any stack of cut sheets will be selected in response to the requirement of size and/or material for cut sheets. If a plurality of such cassettes can simultaneously be mounted within the apparatus so that one of them can automatically be selected simply by depressing a selector button, it is convenient in that the selection of cut paper sheets can more simply and easily be carried out in response to the requirement of size and/or material for cut sheets.

2. Description of the Prior Art

In paper cassettes which have currently been used for such a purpose, the accommodation capacity is 250 or 500 sheets at maximum. If a number of copies, for example, 1000 or 2000 are to be continuously made, several supplies of paper must cumbersomely be carried out to that cassette. In each supply of paper, the copying operation is unavoidably interrupted so that a high speed capability of a copying machine will unsatisfactorily be utilized.

There are known some high-grade and high-speed copying machines of such a type that a large-sized deck or tray is used to contain and feed a number of paper sheets, for example, 2000. Such a deck or tray mechanism is exclusively mounted in that copying machine, so that is cannot be used in an other copying machine of a different type.

As disclosed in Japanese Laid-open Patent Application No. 17960/1982, there has recently been proposed an image forming apparatus in which, if a great number of paper sheets are required in an continuous operation, a paper feed device having an increased accommodation capacity can be connected with the image forming apparatus in place of a paper cassette having its reduced accommodation capacity and feed the paper sheets to the image forming apparatus as if the paper cassette did, without any change of specification in the image forming system. However, such a paper feed device has to be connected to the image forming apparatus. Therefore, there still remains some difficulties in that the paper feed device cannot widely and easily be used in various types of image forming apparatus.

In order to overcome the just mentioned problem, there has further been proposed a paper feed apparatus which comprises a large-sized paper-containing section accommodatable of a great number of cut paper sheets, a paper conveying section operatively connected with the paper-containing section and mountable into an image forming device through its entrance for the paper cassette, and a paper feeding mechanism for feeding the paper sheets from the large-sized paper-containing section to the paper conveying section one by one, whereby, when the previous paper sheet has been fed out of the paper conveying section under the action of paper feed means in the image forming device, a paper sheet can automatically be fed from the large-sized paper-containing section to the conveying section and then caused to wait in the conveying section. See Japanese Laid-open Patent Application No. 112247/1982.

The paper conveying section of this paper feed device is inserted into the cassette receiving opening of the conventional image forming system of paper-cassette insertion type having no built-in large-sized deck mechanism. Since the paper feed device includes its large-sized paper-containing section, the image forming apparatus continuously receives a number of cut paper sheets, for example, 1000 or 2000 from the paper-containing section so that the copying operation thereof will be carried out up to the desired number of copies within the number of the fed cut sheets without interruption.

In the conventional constructions (particularly, Japanese Laid-open Patent Application No. 112247/1982), the paper sheets are fed to the paper conveying section by rotation of paper feed roller means provided above the paper-containing section and then stopped at a predetermined position in the paper conveying section as the feed roller means in deenergized. Thus, the paper sheets should always be acted on by the feed roller means. Since the feed roller means is located externally of the paper conveying section, paper sheets of a length smaller than that of the paper conveying section cannot be used in such an arrangement.

In the construction of Japanese Laid-open Patent Application No. 112247/1982, the paper sheet feed to the paper conveying section is unstable since it is effected only by the use of feed roller means, resulting in easy paper jam.

SUMMARY OF THE INVENTION

It is the fundamental object of the present invention to provide a device which is substantially free from the above drawbacks.

It is an object of the present invention to provide an automatic paper feed device in the form of a more reliable and widely usable unit which can be used in combination with various image forming systems of paper-cassette insertion type and in which a great number of copies, for example, 1000 or 2000 can continuously be made without interruption simply by physically inserting the cut sheet conveying section of the above unit into a cassette receiving opening of the image forming system having no large-sized deck mechanism contained therein, without any electrical cable (signal line) connection between the unit and the image forming system.

Another object of the present invention is to provide an automatic paper feed device which can utilize cut sheets of a length smaller than that of the cut-sheet conveying section.

Still another object is to provide an automatic paper feed device which can smoothly feed cut-sheets from a cut-sheet table to a cut-sheet conveying section.

A further object is to provide an automatic paper feed device which can feed cut sheets such that the sheet will not be overlapped by the succeeding sheet.

These and other objects, features and advantages of the present invention will become more apparent upon a consideration of the following description of the preferred embodiment of the present invention taken in conjunction with the accompanying drawings.

According to an embodiment of the present invention, two cut-sheet sensors are disposed spaced away from each other along a path of conveyed sheets to detect the feeding and conveying of cut sheets. If the paper feed device according of the embodiment of the present invention is used in any of various forming apparatus which are different from one another with respect to the speed of the image forming process or each of which is changed in speed in association with change of magnification, the paper feed device can be controlled such that successive cut sheets will always be fed and conveyed keeping a constant spacing between them. Thus, the cut sheets can positively be fed to the machine body one by one so that a great number of copies will continuously be carried out without interruption.

In this paper feed device according to the present invention, as a cut sheet is fed to the machine body under the action of paper feed means provided in the machine body after the cut sheet has been caused to wait in the cut-sheet conveying section of the paper feed device which was inserted into the cassette receiving opening of the machine body, the succeeding cut sheet is automatically fed out of the cut-sheet containing section to the cut-sheet conveying section one at a time. Therefore, no signal line for controlling timing or others is required between the machine body and the paper feed device. The paper feed device can positively be connected with the machine body simply by physically inserting the cut-sheet conveying section of the paper feed apparatus into the cassette receiving opening of the machine body as in the cassette. Consequently, the paper feed device of the present invention can be used in any of the existing image forming systems of paper cassette insertion type so that a great number of copies can be made without interruption.

In the paper feed device according to the present invention, the cut-sheet conveying section includes such a cut-sheet conveying mechanism that the cut sheets can be conveyed, stopped and caused to wait within the cut-sheet conveying section. Accordingly, the size of cut sheets will not be limited depending on the length of the cut-sheet conveying section. Further, the cut sheets can more smoothly be fed.

DESCRIPTION OF THE PREFERRED EMBODIMENTS

Figure 1:
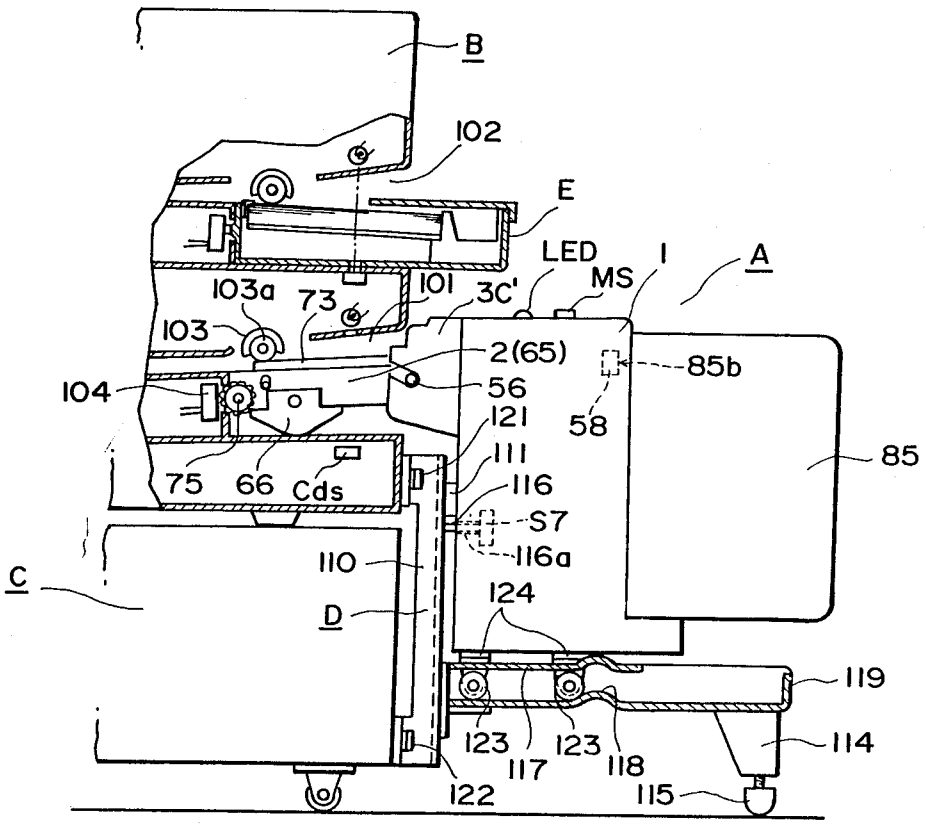
FIG. 1 is a side view, partially broken, of a paper feed apparatus according to the present invention connected with an image forming system.

The present invention will now be described in detail in connection with an embodiment thereof which is illustrated in the drawings.

(1) General construction of a paper feed device according to an embodiment of the present invention connected with an image forming machine (mainly, FIGS. 1 through 3):

FIG. 1 is a side view, partially broken, of a paper feed device A connected with an image forming machine B such as an electrophotographic copying machine or the like (hereinafter called "machine body").

The paper feed device A generally comprises:

(i) a large-sized paper-containing section 1 including a vertically movable paper-containing (or supporting) table mechanism for supporting a stack of a large number of cut paper sheets (for example, about 2000) and a paper feeding mechanism for feeding the cut paper sheets from the top of the stack one by one;

(ii) a section 2 for conveying and holding a cut paper sheet, the section extending forwardly from the front and upper portion of the paper-containing section 1 and being inserted into a paper-cassette insertion opening 101 in the machine body B; and (iii) a control circuit section.

In FIG. 1, reference character C denotes a pedestal on which the machine body B is mounted; and symbol D designates a frame for connecting the paper feed device A with the machine body B.

Figures 2, 3:
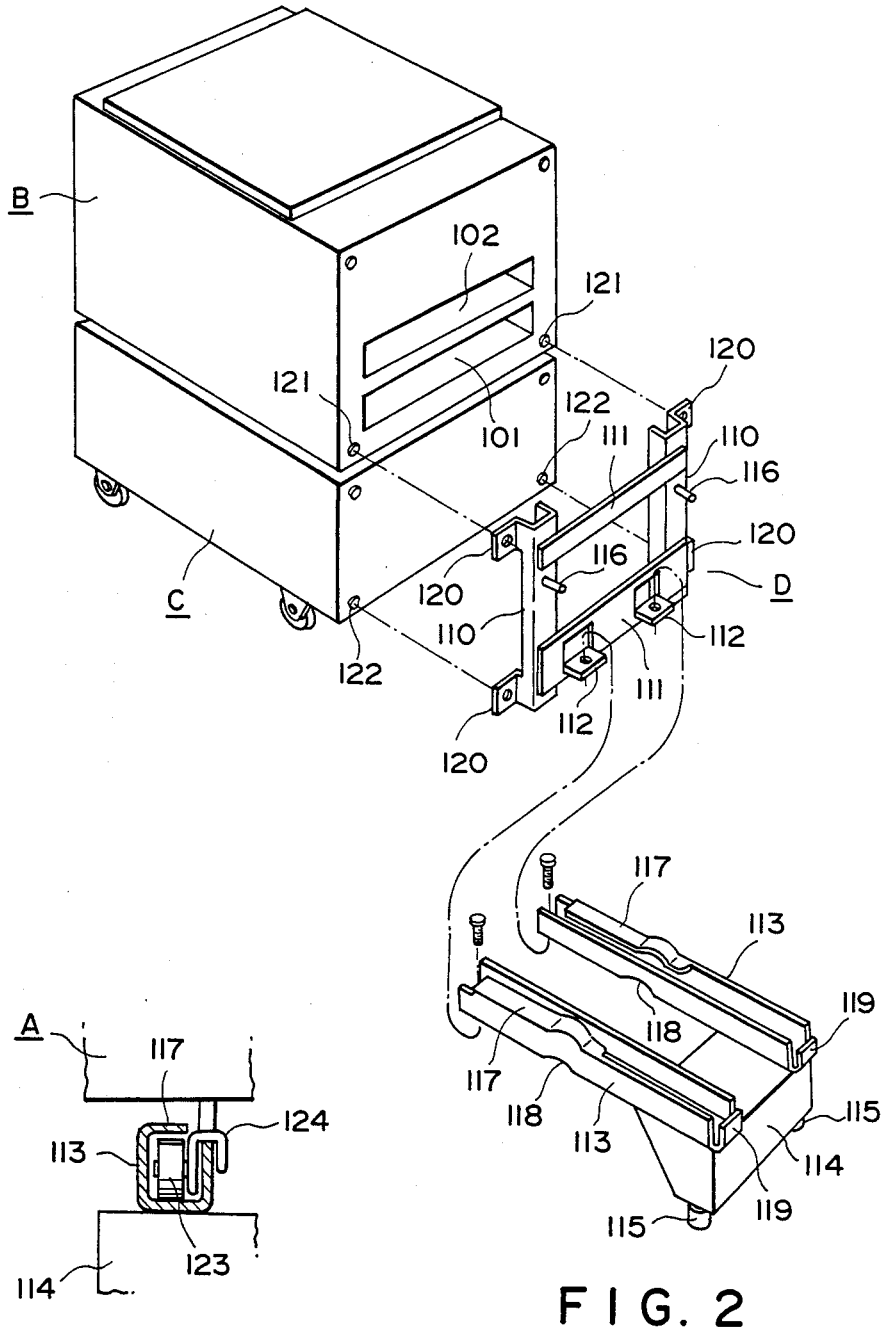
FIG. 2 is an exploded perspective view of a table.
FIG. 3 is a cross-sectional view of a rail including a roller mounted therein.

As best seen from FIG. 2, the frame D comprises a vertical back frame portion including vertical frame members 110 spaced transversely away from each other and horizontal frame members 111 spaced vertically away from each other, the vertical frame members being connected with the corresponding horizontal frame members as by welding or screwing; a pair of horizontal rails 113 connected at the ends with the respective horizontal lugs 112 rearwardly extending from the lower horizontal frame member and spaced transversely away from each other by means of screws; a common leg 114 with the bottom of each rail 113 at the opposite end as by welding or screwing; two adjustable floor contacting seats 115 mounted on the bottom of the common leg 114 and spaced transversely away from each other; and a positioning pin 116 rearwardly extending from each vertical frame member 110 of the vertical back frame portion substantially at the middle thereof.

Each of the horizontal rails 113 is a channel rail of U-shaped cross-section with the length thereof being larger than the longitudinal dimension of the bottom of the large-sized paper-containing section 1 in the paper feed device A. The outer sidewall of each of the horizontal rails 113 has an upward extension 117 turned toward the upward opening of that rail to substantially close the forward portion of the channel. Each of the horizontal rails 113 also includes a raised portion 118 formed in the internal bottom thereof substantially at the middle and a stopper 119 upwardly turned from the rearward end of the horizontal rail 113.

Each of the vertical frame members 110 in the back frame portion of the frame D includes outwardly extending lugs 120 formed therein at the upper and lower ends thereof. The frame D is firmly mounted on both the machine body B and pedestal C by fastening the lugs 120 of the frame D against the machine body and pedestal using screws 121 on the machine body and screws 122 on the pedestal. The floor contacting seats 115 of the leg 114 is adjustably turned to contact the floor before or after the frame D is attached to the machine body B and the pedestal C.

The large-sized paper-containing section 1 of the paper feed device A includes four rollers 123 mounted on the bottom thereof adjacent the respective corners, each of which is located within the channel of the corresponding horizontal rail 113. An inverse U-shaped positioning member 124, for example, of a synthetic resin material is provided adjacent each of the rollers 123 which are located in the right-hand horizontal rail 113. As shown in FIG. 3, each of the inverse U-shaped positioning members 124 is engaged by the top edge of the opposite sidewall having no extention 117 in the right-hand horizontal rail 113.

The paper feed device A is connected with the machine body B in the following procedure: First of all, the forward rollers 123 of the paper feed device A are located within the corresponding horizontal rails 113 of the frame D which has been firmly attached to both of the machine body B and pedestal C. Simultaneously, the inverse U-shaped member 124 adjacent the forward and right-hand roller 123 is fitted over the top edge of said sidewall of the right-hand horizontal rail 13. The entire paper feed device A is then moved forwardly with the forward rollers 123 being caused to ride across the raised portions 118 on the bottoms of the rails 113. Subsequently, the rearward rollers 124 of the paper feed device A are located within the respective horizontal rails 113 with the rearward U-shaped positioning member 124 being engaged by the top edge of the sidewall of the right-hand horizontal rail. The paper feed device A is further moved forwardly until the rearward rollers 123 ride across the raised portions 118 in the horizontal rails 113.

As the paper feed device A is forwardly moved, the one-paper conveying and holding section 2 extending forwardly therefrom enters the cassette insertion opening 101 of the machine body B beyond the upper horizontal frame member 111 of the frame D. When the rearward rollers 123 clear the raised portions 118 of the respective horizontal rails 113, the front face of the large-sized paper-containing section 1 engages the upper horizontal frame member 111 of the frame D to prevent the paper feed device A from further moving forwardly. At this point of time, the positioning pins 116 on the frame D are sufficiently inserted into the corresponding pin receiving apertures **116*a* in the paper feed device A to properly position the one-paper conveying and holding section 2 thereof within the cassette insertion opening 101 of the machine body B. The paper feed device A can stably be held at its final position by the raised portions 118 of the horizontal rails 113**. Thus, the paper feed device A is properly and positively connected with the machine body B.

As understood from the foregoing, the first positioning of the paper feed device A relative to the machine body B is precisely made by the machine screws 121 and 121 on the machine body B; the final position of the paper feed device A is obtained by engaging it with the upper horizontal frame member 111 of the frame D; and the lateral positioning of the device A (perpendicular to the rails) is accurately made by the engagement of the positioning pins 116 on the frame D in the corresponding apertures **116*a* of the device A and also by the engagement of the rails 113 with the inverse U-shaped members 124 on the device A. Although two positioning pins 116 are illustrated in FIG. 1, a single pin may be used. The vertical position of the paper feed device A is precisely obtained by the mount of the frame D on the machine body B by means of the screws 121 and the position of the frame rails 113. In this manner, the paper feed device A can be precisely and positively connected with the machine body B in a proper positional relationship with the cassette insertion opening 101 thereof simply by placing the paper feed device A on the frame rails 113** and then forwardly moving the paper feed device A through a sufficient distance.

When the paper feed device A is connected with the machine body B, the four rollers 123 of the paper feed device are located within the channel rails 113 below the turned extensions 117 thereof so that the device A will be prevented from upwardly moving.

Upon jamming in the cassette insertion opening 101 of the machine body B, the paper feed device A is rearwardly moved with the rearward rollers 123 thereof being caused to ride across the corresponding raised portions 118 of the rails 113 until these rearward rollers engage the respective stoppers 119 of the rails 113. At this time, the one-paper conveying and holding section 2 of the paper feed device A is to of the cassette insertion opening 101 of the machine body B so that the jam will easily be overcome. Subsequently, the paper feed device A will forwardly be moved along the rails 113 in the same manner as aforementioned, so that the device A can be connected with the machine body B.

The illustrated machine body B also includes another cassette insertion opening 102 above the cassette insertion opening 101. In the illustrated embodiment, the one-paper conveying and holding section 2 of the paper feed device A is exclusively inserted into the lower cassette insertion opening 101. Upon connection of the paper feed device A with the machine body B, a cassette E (FIG. 1) may remain inserted in the upper cassette insertion opening 102. If required, the cassette E may be selected by actuating a paper selector button on the machine body B such that paper sheets can be fed to the machine body B from the cassette E.

The back frame portion of the frame D may include hook means engaged by cross beam means on the bottom of the pedestal C to fasten the lower end of the back frame portion to the pedestal C rather than use of the screws 122 shown in FIGS. 1 and 2.

Figure 4:
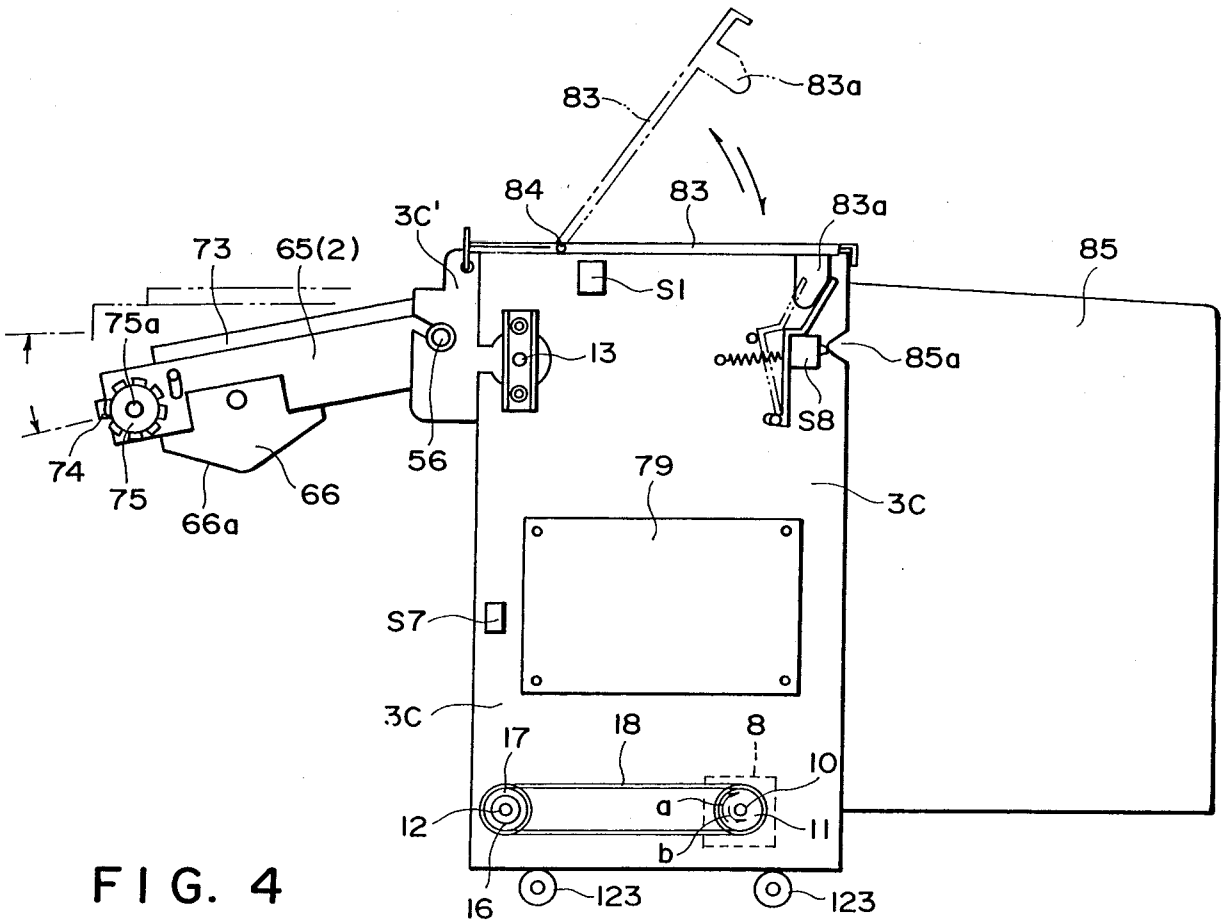
FIG. 4 is a right-hand side view of the paper feed apparatus with the right-hand side board being removed.
Figure 5:
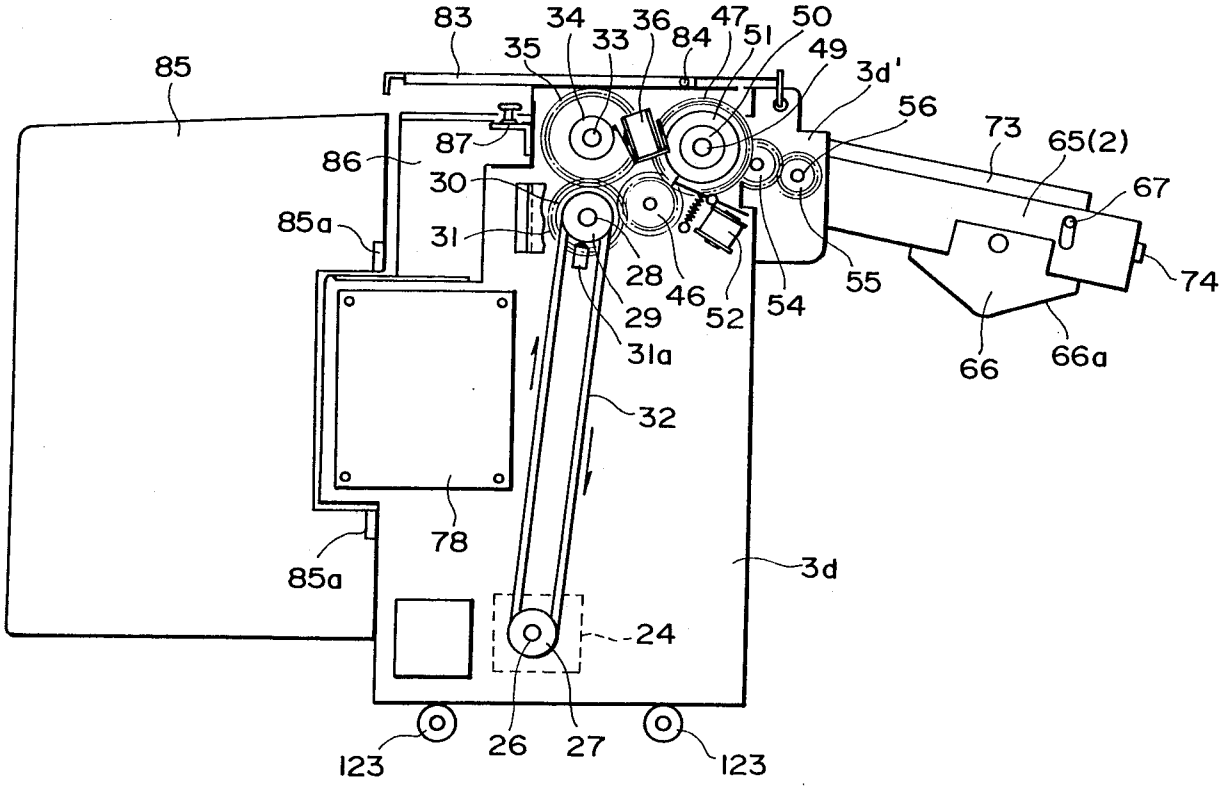
FIG. 5 is a left-hand side view of the paper feed apparatus with the left-hand side board being removed.
Figure 6:
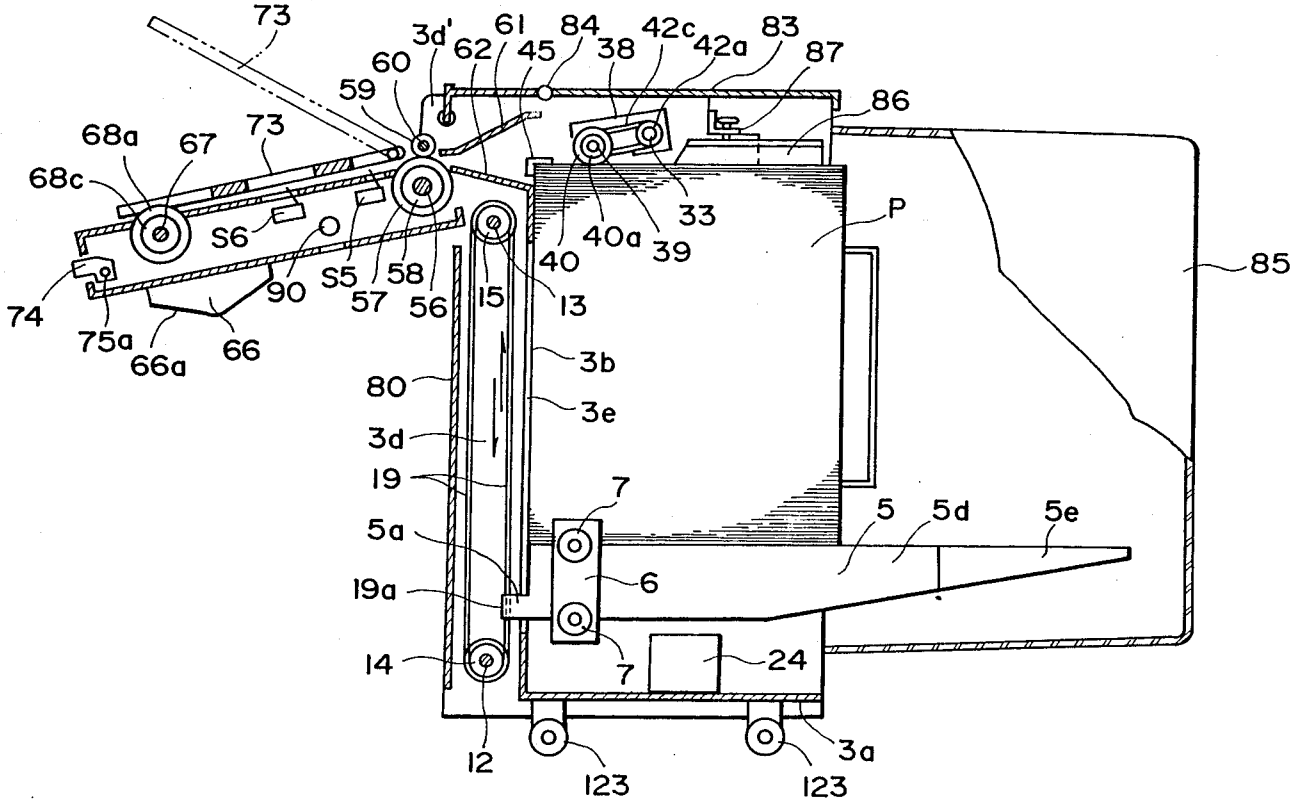
FIG. 6 is a longitudinal cross-section of the paper feed apparatus.
Figure 7:
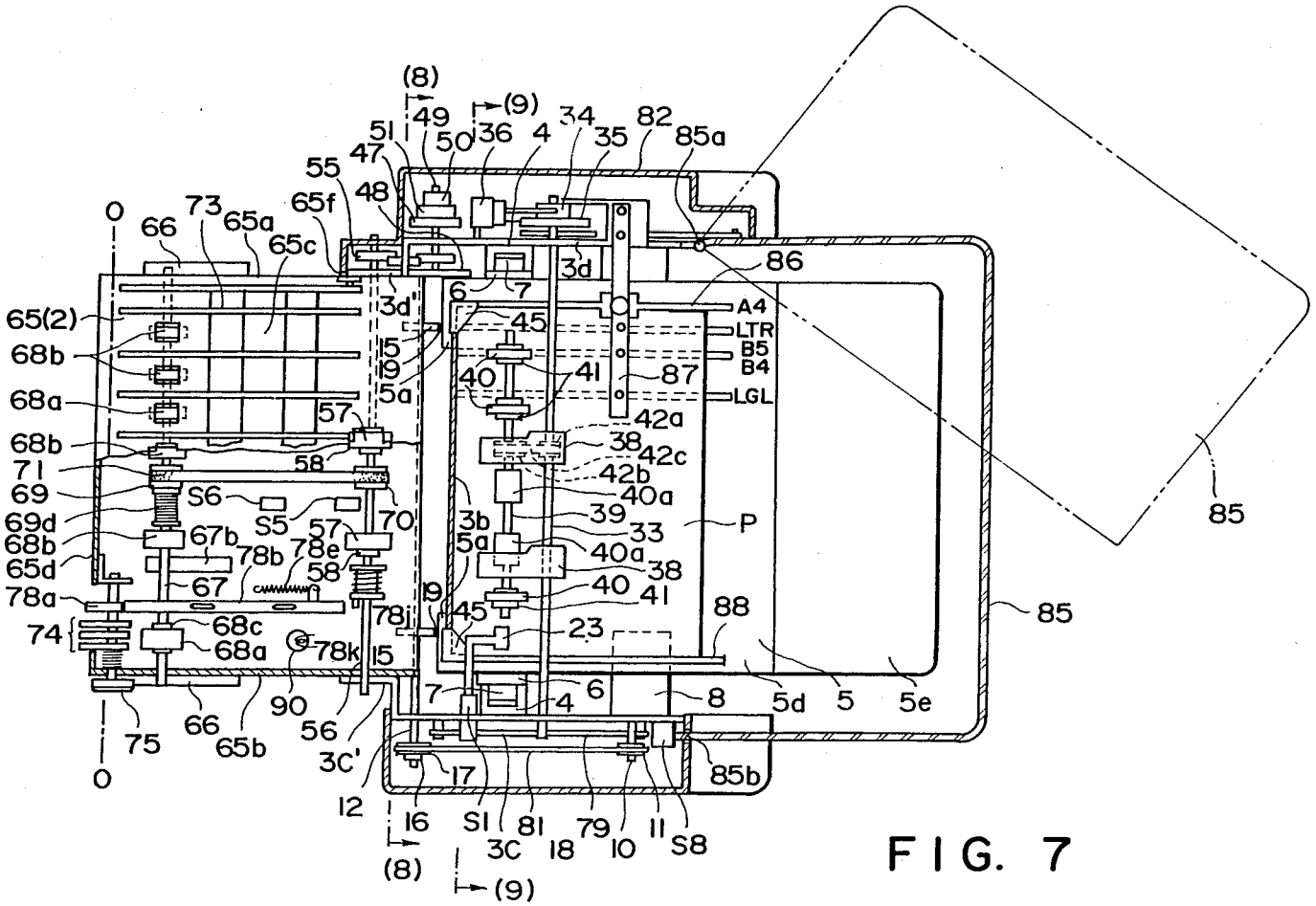
FIG. 7 is a horizontal cross-section of the paper feed apparatus.
Figure 9:
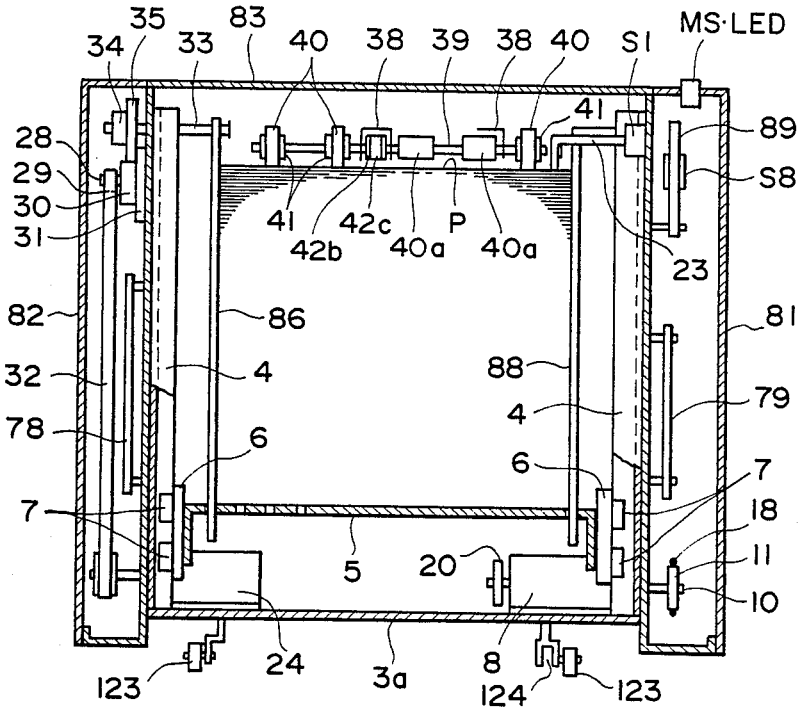
FIG. 9 is another vertical cross-section of the paper feed apparatus, taken along a line 9—9 in FIG. 7.
Figure 11:
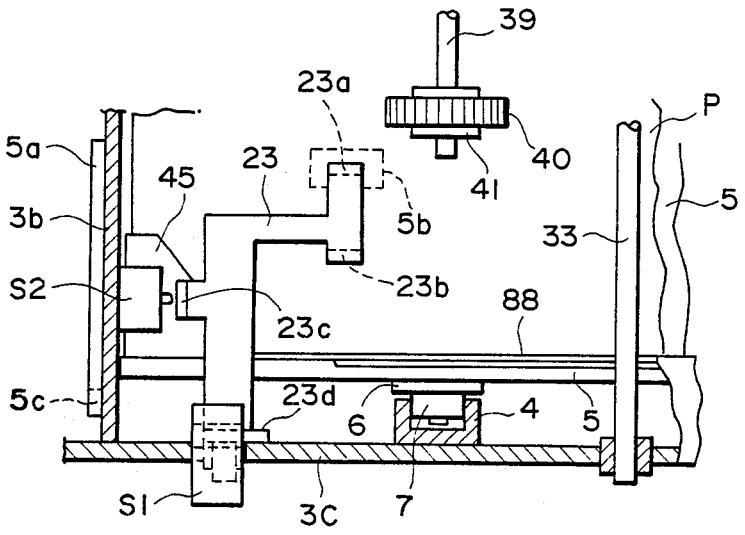
FIG. 11 is an enlarged plan view showing a swingable lever for detecting paper.

(2) Vertically movable paper containing table mechanism:

The paper feed device A comprises a chassis being rectangular in horizontal cross-section, the chassis including a bottom board 3*a*, a front board 3*b*, a right-hand side board 3*c* and a left-hand side board 3*d* as shown in FIGS. 4 through 6. The chassis is opened at its back and top faces. The paper feed device A also includes vertical channel rails 4 each of which is of U-shaped cross-section and which are respectively mounted on the right- and left-hand side boards 3*c* and 3*d* of the housing in transversely aligned positions adjacent the forward edges of the side boards 3*c* and 3*d* as shown in FIGS. 7, 9 and 11. The paper feed device A further comprises a table 5 on which a stack of paper sheets is placed, the table 5 including a pair of vertical plates 6 fixedly mounted thereon at the forward end and aligned transversely with each other. Each of the vertical plates 6 includes a pair of vertically spaced rollers 7 rotatably mounted thereon. The rollers 7 of each of the vertical plates 6 are operatively located within the corresponding vertical rail 4. Thus, the table 5 is movable vertically along the rail 4.

A motor 8 for driving the table 5 (hereinafter called "lifter motor") is mounted on the inner wall of the right-hand side board 3*c* of the chassis at the lower portion thereof. The rotating shaft of the lifter motor 8 is operatively connected with a reduction gear box 9 (FIG. 10) which includes a final reduction shaft 10 extending outwardly through the right-hand side board 3*c* of the chassis with the outer end thereof being connected with a sprocket 11.

Figure 8:
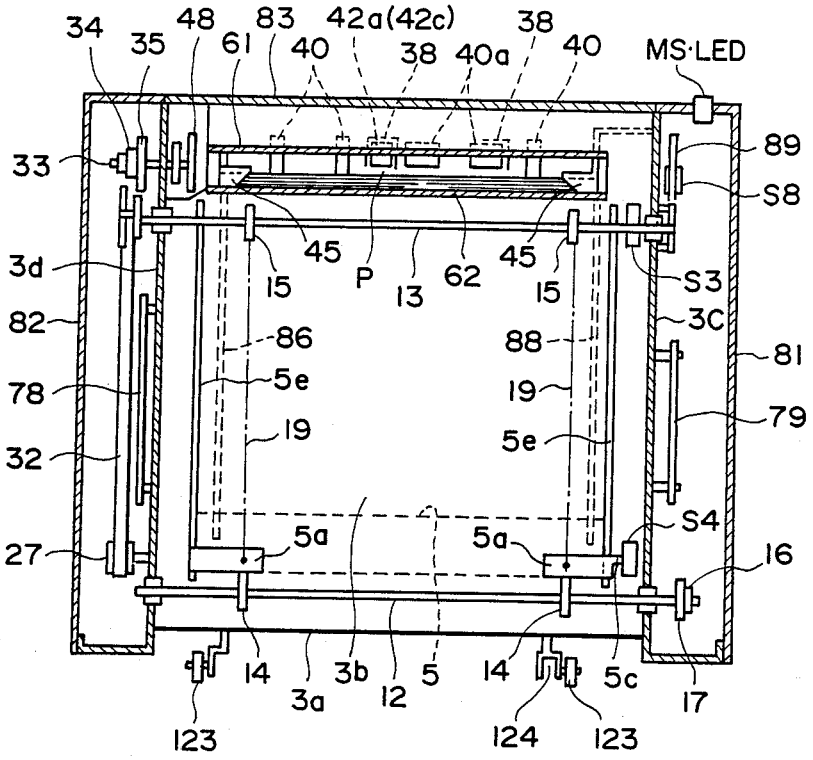
FIG. 8 is a vertical cross-section of the paper feed apparatus, taken along a line 8—8 in FIG. 7.

Two parallel shafts 12 and 13 are rotatably supported by the side boards 3*c* and 3*d* of the chassis at the upper and lower portions adjacent to the respective forward edges thereof as shown in FIGS. 6 and 8. The rotatable shaft 12 includes sprockets 14 fixedly connected thereto adjacent the opposite ends while the rotatable shaft 13 also includes sprockets 15 fixedly connected thereto adjacent the opposite ends. However, the sprockets 15 may freely be rotated relative to the shaft 13. The lower rotatable shaft 12 has an extension extending from the right end thereof outwardly through the right-hand side board 3*c* of the chassis. On this extension of the shaft 12 is mounted a sprocket 17 through a one-way clutch (spring clutch) 16.

An endless chain 18 is spanned between the sprocket 11 of the drive shaft 10 and the sprocket 17 of the lower shaft 12. Further, a pair of vertical endless chains 19 are spanned respectively between the sprockets 14 and 15 of the shafts 12 and 13. As seen best from FIGS. 6 and 8, part 19*a* of each of the vertical chains 19 is fixedly connected with an arm plate 5*a* which extends forwardly from the forward end of each sidewall in the table 5 through one of vertically extending slots 3*e* formed in the front board 3*b* of the chassis.

If the lifter motor 8 is energized to rotate forwardly as shown by arrow b in FIG. 4, the rotation thereof is transmitted to the lower shaft 12 through the sprocket 11, chain 18, sprocket 17 and one-way clutch 16 so that the vertical chains 19 will be run to move the table 5 upwardly along the rails 4 and 4.

If the lifter motor 8 is energized to rotate oppositely as shown by arrow a in FIG. 4, the sprocket 17 is rotated in lost motion through the one-way clutch 16 such that the table 5 will move downwardly along the rails 4 and 4 under gravity, and the vertical chains 19 and 19, sprockets 15, 14, 14 and 15, and the shafts 13 and 12 rotate oppositely.

Figure 10:
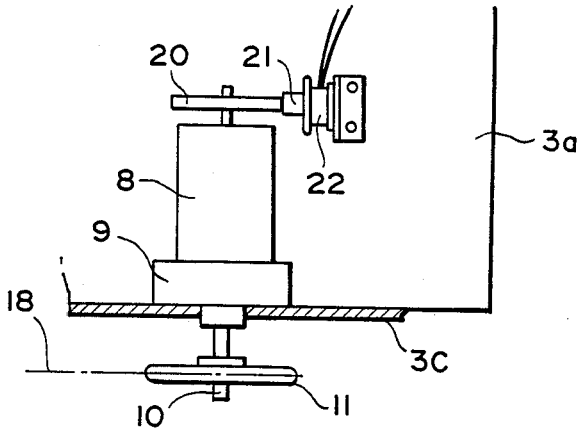
FIG. 10 is an enlarged plan view showing a lifter motor section.

As shown in FIGS. 9 and 10, there are provided a toothed disc 20 fixedly connected with the rearward end of the lifter motor shaft for braking the lifter motor and a pawl plate 21 spring-loaded to engage the toothed disc 20 and which can be moved away from the toothed disc 20 by an electromagnetic attracting device 22 when energized. The electromagnetic attracting device 22 is energized from a time point immediately before the lifter motor 8 begins to be energized to rotate in either direction to a time point immediately after the lifter motor 8 has been deenergized. Upon the energization of the electromagnetic device 22, the pawl plate 21 is held moved away from the toothed disc 20 so that the lifter motor 8 will be permitted to rotate in either direction. If the electromagnetic attracting device 22 is deenergized, the pawl plate 21 engages the toothed disc 20 to prevent the motor shaft from rotating in lost motion. When the table 5 is in its raised position, therefore, it is prevented from freely downwardly moving along the rails 4 by its own weight and the weight of the stack of paper P placed on the table 5 while rotating the shaft of the lifter motor 8.

Figure 12:
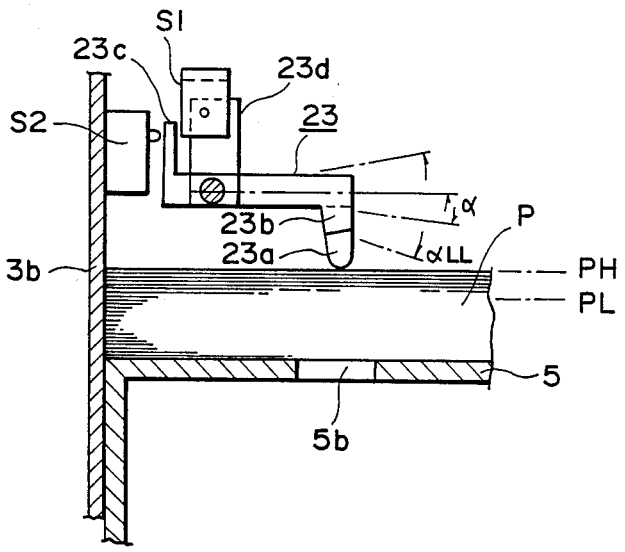
FIG. 12 is a side view of FIG. 11, showing the swingable lever.

As shown in FIGS. 7, 11 and 12, a swingable lever 23 of substantially L-shape for detecting the presence of paper is pivotably supported by the right-hand side board 3*c* on the inner wall adjacent the upper and forward portion thereof. The lever 23 includes a first projection 23*a* downwardly extending from the tip thereof, a second projection 23*b* downwardly extending from the same tip and spaced away from the first projection 23*a*, the second projection 23*b* having its length smaller than that of the first projection 23*a*, a third projection 23*c* upwardly extending from the lever 23 at the middle, and a fourth projection 23*d* upwardly extending from the lever 23 at the opposite or distal end thereof.

The first projection 23*a* contacts the uppermost paper in the stack P on the table 5. The second projection 23*b* serves as a stopper which will engage the upper face of the table 5 when the first projection 23*a* is moved into a hole 5*b* formed in the table 5 if no paper is placed on the table 5. The third projection 23*c* is located opposed to a sensor S2 disposed on the upper and inner wall of the front board 3*b* of the chassis for detecting the stack of paper P when it is upwardly moved beyond a predetermined level. The fourth projection 23*d* is disposed in the optical path of a photoelectric sensor S1 for sensing the uppermost level of the stack of paper P and includes a light source and light receiving element which are disposed on the inner wall of the right-hand side board 3*c* above the lever 23.

If the top level of the paper stack P on the table 5 is in the range of PH to PL (FIG. 12), the first downward projection 23*a* contacts the uppermost paper in the stack P to hold the lever 23 substantially horizontally, that is, in the range of angle shown by $\alpha$ in FIG. 12. At such a position, the fourth upward projection 23*d* blocks the optical path in the photoelectric sensor S1. As a result, it can be sensed that the top of the stack P is in the range of PH to PL as shown in FIG. 12.

As the paper sheets are fed out of the top of the stack P on the table 5 one by one under the operation of a paper feeding mechanism which will be described hereinafter, the stack P is gradually reduced in height. Accordingly, the lever 23 is gradually pivoted clockwise as viewed in FIG. 12. If the lower limit of the first projection 23*a* of the lever 23 reaches the lower level PL, the fourth projection 23*d* thereof is out of the optical path in the sensor S1. As a result, it is sensed that the top of the stack P reaches the lower permissible limit PL.

A signal from the sensor S1 is supplied to the control circuit which in turn energizes the electromagnetic attracting device 22 of said lifter motor 8. Upon this energization, the pawl plate 21 is moved away from the toothed disc 20 of the lifter motor 8. Subsequently, the lifter motor 8 is energized to rotate forwardly so that the table 5 will be moved upwardly to lift the entire stack P. As a result, the lever 23 is pivoted by the top of the stack P counterclockwise as viewed in FIG. 12. The optical path in the sensor S1 is again blocked by the fourth projection 23*d* of the lever 23. After a predetermined time period, the lifter motor 8 is deenergized by the control circuit and then the electromagnetic attracting device 20 is deenergized.

The table 5 is intermittently moved upwardly at each time that, for example, 20 to 30 sheets of paper are fed out of the stack P on the table 5. Therefore, the top level of the stack P is always maintained at a predetermined level in the range of PH to PL.

IF the lowermost paper in the stack P has been fed out of the table 5, until the lever 23 is pivoted to reach the lower limit $\alpha$LL, the first downward projection 23*a* of the lever 23 enters the through-hole 5*b* to engage the second downward projection 23*b* with the upper face of the table 5. At this time, the fourth upward projection 23*d* of the lever 23 is completely out of the optical path in the sensor S1 which in turn generates a signal. This signal is utilized together with another signal from a sensor S3 for sensing the upper limit of the table 5 which will be described, so as to detect the absence of paper on the table 5.

Sensors S3 and S4 (FIG. 8) are, for example, microswitches for respectively sensing the upper and lower limits of the table 5. These sensors are disposed on the outer wall of the front board 3*b* in the chassis at the upper and lower end portions of the right-hand slit 3*e*.

If the upper face of the table 5 reaches the lower limit PL of the stack P, the upper limit sensor S3 is actuated by a projection 5*c* extending from the arm position 5*a* on the table 5 to which one of the vertical chains 19 is connected. When actuated, the sensor S3 generates a signal which is in turn supplied to the input of the control circuit. At this time, some sheets of paper remain on the table 5. After all the sheets of paper have been removed from the table 5, the inclination $\alpha$LL of the lever 23 is sensed by the sensor S1 as described hereinbefore. As a result, the sensor S1 generates a signal which indicates the absence of paper on the table 5 and is supplied to the input of the control circuit.

When the table 5 reaches its lower limit, the lower limit sensor S4 is actuated by the projection 5*c* of the table 5 to generate a signal which will be supplied to the input of the control circuit.

The sensor S2 for detecting the top of the stack when it is upwardly moved beyond a predetermined level will be described hereinafter.

(3) Mechanism for feeding the paper sheets one by one:

As shown in FIGS. 5 and 6, a motor 24 used to feed the sheets of paper one by one, which will be called simply "feed motor", is mounted on the left-hand side board 3*d* of the chassis at the inner and lower portion thereof. The revolution of the motor shaft is reduced by a reduction gear box which includes a final shaft 26 extending outwardly therefrom through the left-hand side board 3*d* with the outer end thereof being fixedly connected with a first timing pulley 27.

Figure 13:
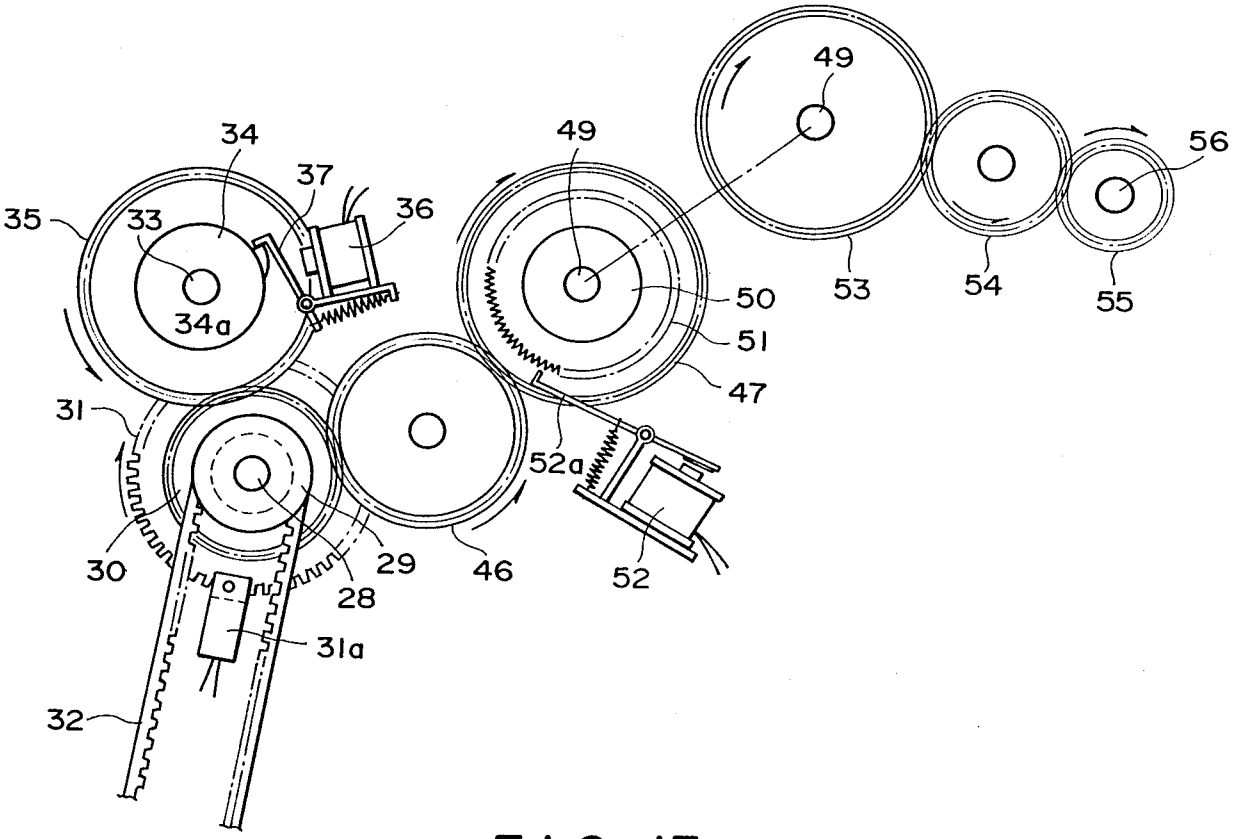
FIG. 13 is an enlarged side view of the gear train in a paper feeding and conveying mechanism.

As shown in FIGS. 5 and 13, a pin shaft 28 is located on the left-hand side board 3*d* at the upper and outer wall thereof and rotatably supports a second timing pulley 29, first gear 30 and toothed encoder disc 31 which are connected with one another as a unit. A timing belt 32 is spanned between the first and second timing pulleys 29 and 32. When the feed motor 24 is energized, the pulley 29, first gear 30 and toothed disc 31 are driven to rotate as a unit.

As shown in FIGS. 6, 7, 11 and 13, a paper feeding support shaft 33 is rotatably supported adjacent the opposite ends by the upper portions of the side boards 3*c* and 3*d* of the chassis. The leftward end of the support shaft 33 has an extension outwardly extending through the left-hand side board 3*d* with the outer end thereof supporting a one-revolution clutch (spring clutch) 34 and a second gear 35. The second 35 is engaged by the first gear 30.

The one-revolution clutch 34 is normally in its clutch-off position in which the pawl 37 of a first electromagnetic attraction device 36 engages a projection 34*a* on an outer ring 34. As a result, even if the first gear 30 is rotated, the second gear 35 freely rotates on the shaft 33 so that the latter will not be driven.

When the first electromagnetic attracting device 36 is instantaneously energized, the pawl arm 37 is disengaged by the outer ring to place the clutch in its clutch-on position. As a result, the second gear 35 is operatively connected with the shaft 33 to drive it. When the shaft 33 rotates substantially through one revolution, the projection 34*a* of the outer ring is again engaged by the pawl arm 37 to place the clutch in ints clutch-off position. As a result, the second gear 35 freely rotates relative to the shaft 33 so that the latter will be stopped to rotate. Thus, the support shaft 33 will intermittently be rotated through one revolution each time that the first electromagnetic attracting device 36 is energized in a moment.

As shown in FIGS. 6, 7 and 9, arms 38 and 38 of inverse U-shape in cross-section are pivotably mounted on the paper feeding support shaft 33 and spaced away from each other. Each of the arms 38 is restrained from moving along the length of the shaft 33. The arms 38 rotatably support a feed roller shaft 39 on which a plurality of feed rollers 30 are mounted through the respective one-way clutches 41 with these feed rollers being spaced away from one another. Weight rollers 40*a* also are fixedly mounted on the shaft 39 between two adjacent feed rollers 40. A timing pulley 42*a* is fixedly mounted on the shaft 33 within one of the feed roller supporting arms 38 while another timing pulley 42*b* is fixedly mounted on the feed roller shaft 39 within the same arm 38. A timing belt 42*c* is spanned between the timing pulleys 42*a* and 42*b*. Two separation pawls 45 and 45 are provided above the table 5 to contact the uppermost paper in the stack P on the table 5 at the right- and left-hand corners in the leading edge thereof. These separation pawls 45 and 45 are respectively formed in a stationary reference side plate 88 and movable side plate 86 at the forward top portions thereof, which will be described in detail hereinafter.

As the paper feeding support shaft 33 rotates through one revolution, the rotation thereof is transmitted to the feed rollers 40 through the pulley 42*a*, timing belt 42*c*, pulley 42*b*, feed roller shaft 39 and one-way clutches 41 so that the feed rollers 40 will be driven to rotate in such a direction that the uppermost paper in the stack P is fed forwardly beyond the separation pawls 45 and 45.

The weight rollers 40*a* function to contact the feed rollers 40 with the uppermost paper in the stack under a proper pressure.

As shown in FIGS. 5 and 13, a third gear 46 is rotatably supported by a pin shaft extending from the outer wall of the left-hand side board 3*d* of the chassis and engages the first gear 30. A fourth gear 47 and clutch (spring clutch) 50 are mounted on a shaft 49 which is rotatably supported by the left-hand side board 3*d* of the chassis and an auxiliary side board 48 (FIGS. 7 and 8). The clutch 50 has an outer ring 51 including small tooth formed therein at the outer periphery. The fourth gear 47 engages the third gear 46. There is a second electromagnetic attracting device 52 which functions to swingably move a pawl arm 52*a* toward and away from the outer toothed ring 51. Upon deenergization of the second electromagnetic attracting device 52, the pawl arm 52*a* is spring-loaded to be out of the outer ring 51 of the clutch 50. In this position, therefore, the clutch 50 is in its ON position to connect the fourth gear 47 with the shaft 49. If the second electromagnetic attracting device 52 is energized, the pawl arm 52*a* engages the outer toothed ring 51 to place the clutch 50 in its OFF position so that the fourth gear 47 will be disconnected with the shaft 49 to be freely rotatable.

A fifth gear 53 is fixedly mounted on the shaft 49 and engages a sixth gear (idler) 54 which in turn engages a conveying roller shaft gear (seventh gear) 55.

As shown in FIGS. 6, 7 and 13, a first conveying roller shaft 56 is rotatably supported by bearing plates extending forwardly from the forward and upper portions of the side boards 3*c* and 3*c* of the chassis. The seventh gear 55 is fixedly mounted on the shaft 56 at the leftward end thereof.

Figure 14:
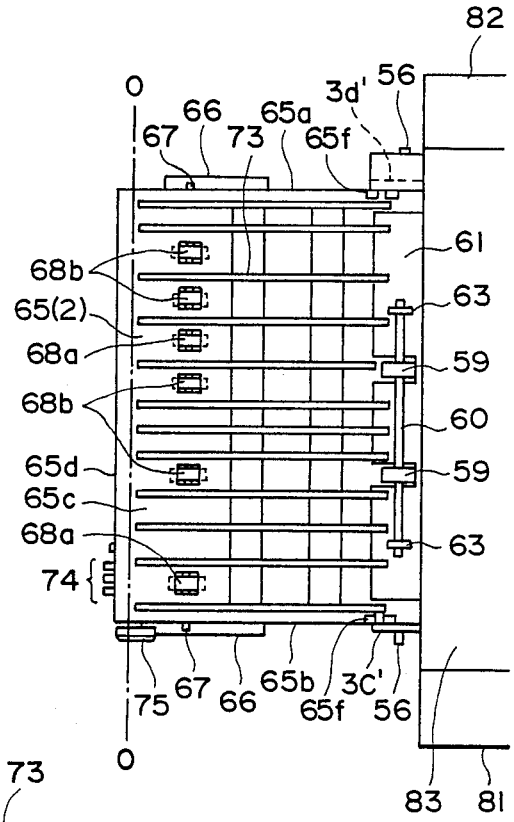
FIG. 14 is a plan view of a section in which a paper sheet is conveyed and caused to wait.

First conveying rollers 57 is mounted on the shaft 56 through the respective one-way clutches 58 and contacted by driven pressure rollers 59 under a proper pressure as shown in FIGS. 6 and 14. The pressure rollers 59 are supported by a shaft 60 which is in turn supported by protrusions 63 spaced away from each other and formed on a guide plate 61. The guide plate 61 is located between the feed rollers 40 and the conveying rollers 57. Another guide plate 62 cooperating with the guide plate 61 is located below the guide plate 61. The driven pressure rollers 59 are rotatably mounted on the shaft 60. Each of the driven pressure rollers 59 always contacts the corresponding conveying roller 57 through the respective notch which is formed in the upper guide plate 61.

If the feed motor 24 is energized and the second electromagnetic attracting device 52 is deenergized, the clutch 50 is in its ON position such that the rotation of the feed motor 24 is transmitted to the first conveying roller shaft 56 through the first gear 30, third gear 46, fourth gear 47, clutch 50, shaft 49, fifth gear 53, sixth gear 54 and seventh gear 55 in this order. As a result, the first conveying rollers 47 are rotated to feed the paper sheets. Thus, the driven pressure rollers 49 also are rotated.

If the second electromagnetic attracting device 52 is energized, the clutch 50 is disengaged so that the fourth gear 47 freely rotates on the shaft 49. Thus, the first conveying rollers 47 also are not rotated.

(4) One-sheet conveying and holding section 2:

This section 2 includes a base 65 which is in the form of a plane box and connected with the front board 3*b* of the chassis immediately before the first conveying roller shaft 56. The width and thickness of the base 65 are substantially equal to those of a paper cassette containing 250 sheets of paper. The length of the base 65 is slightly larger than that of the cassette insertion opening in the machine body B. The base 65 is swingable about the first conveying roller shaft 56 from its substantially horizontal position to its inclined position in which the base is downwardly slanted by about 10° (see FIG. 4).

In this manner, the one-sheet conveying and holding section 2 can easily be inserted into the cassette insertion opening of the machine body B for a 250-sheet cassette when the paper feed device A is connected with the machine body B. Since the base 65 is downwardly swingable about the shaft 56, the one-sheet conveying and holding section 2 can smoothly be inserted into the cassette insertion opening even if there is any slight difference in height.

As shown in FIGS. 4 and 5, downwardly extending cam type spacer plates 66 are detachably attached respectively to the forward and outer walls of the respective side boards 65*a* and 65*b* in the box-shaped base 65. If the cassette insertion opening 101 of the machine body B is adapted to receive a relatively large-sized cassette containing 500 sheets of paper as in the illustrated embodiment, the spacer plates 66 are used to snugly fit the one-sheet conveying and holding section 2 into the cassette insertion opening 101.

Figure 15:
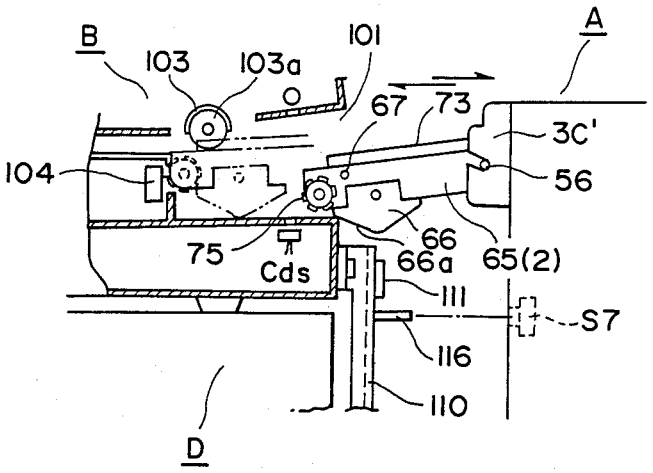
FIG. 15 is a side view of the section shown in FIG. 14 before the paper feed apparatus is connected to the image forming machine.

More particularly, when the paper feed device A is forwardly moved along the rails 113 to connect it with the machine body B, the spacer plates 66 first engage the lower edge of the cassette insertion opening 101 at the forward slopes 66*a* thereof as shown in FIG. 15. If the paper feed device A is further forwardly moved, the slopes 66*a* of the spacer plates 66 slide over the lower edge of the cassette insertion opening 101 to provide an upward force to the plane box-like base 65 about the shaft 56. Thus, as the paper feed device A is forwardly moved to cause the spacer plates 66 to slide over the lower edge of the cassette insertion opening 101, the base 65 can be pivoted upwardly to its substantially horizontal position and smoothly inserted into the cassette insertion opening 101 to its inner end without any vertical motion.

In this manner, the one-sheet conveying and holding section 2 of the paper feed device A according to the present invention can easily and positively be contained in the cassette insertion opening 101 of the machine body B as shown in FIG. 1, independently of any dimensional difference between the one-sheet conveying and holding section 2 and the cassette insertion opening 101 which may be for 250 sheets cassette or 500 sheets cassette. In such a position, a second conveying roller 68a mounted in the base 65 of the one-sheet conveying and holding section 2 as will be described contacts an auxiliary idle roller 103*a* on the machine body B. A paper size specifying cam plate forwardly extending the front board of the base 65 as will be described contacts one of paper size detecting switches 104 provided in the machine body B, so that the machine body B and the paper feed device A are operatively associated in proper manner (FIG. 1).

Figure 16:
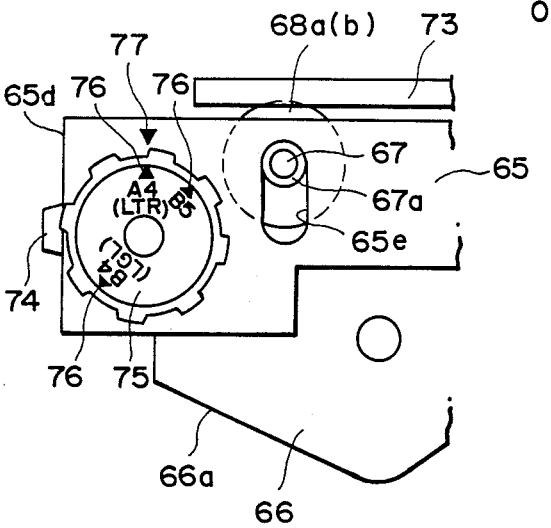
FIG. 16 is an enlarged side view of a dial portion used to select the size of paper sheet.

As shown in FIGS. 6 and 7, a second conveying roller shaft 67 is disposed within the forward portion of the base 65 parallel to the first conveying roller shaft 56. The shaft 67 is rotatably supported at the opposite ends by bearings 67*a* each of which is slidably mounted in a vertical slot 65*e* (FIG. 16) formed in the corresponding one of side plates 65*a* and 65*b* of the base 65. The bearing 67*a* is normally urged upwardly by a leaf spring 67*b* (FIG. 7) to engage to the upper end of the vertical elongated slot 65*e*.

As shown in FIGS. 7 and 14, a plurality of conveying rollers 68*a* and 68*b* are mounted on the second conveying roller shaft 67 and spaced away from one another along the length of the shaft 67. The roller 68*a* is mounted on the shaft 67 through a one-way clutch 68*c* (FIG. 6) while the rollers 68*b* are rotatably mounted on the same shaft. The rollers 68*b* are of a diameter slightly smaller than that of the roller 68*a*.

Each of the second conveying rollers 68*a* and 68*b* partially extends upwardly through one of apertures formed in the forward portion of the top board 65*c* of the base 65. When the paper feed device A is connected with the machine body B, the rollers 68*a* and 68*b* are positioned opposed to conveying rollers 103 of rubber and idle roller 103*a* with the roller 68*a* engaging the idle roller 103*a* to slightly downwardly move the second conveying roller shaft 67 against the force of the leaf spring 67*b*. As a result, the roller 68*a* engages the idle roller 103*a* under pressure by the leaf spring 67. Since the rollers 68*b* are of a diameter slightly smaller than that of the roller 68*a* as described above, each of the rollers 68*b* is spaced away from the idle roller 103*a* of the corresponding feed roller 103 by very small distance.

Figure 17:
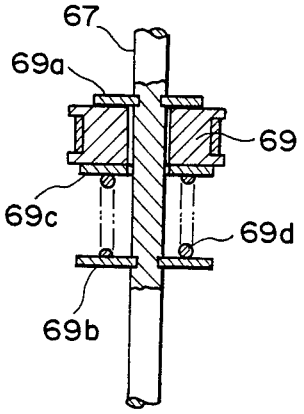
FIG. 17 is an enlarged plan view of a frictional clutch mechanism.

As shown in FIGS. 7 and 17, a timing pulley 69 is rotatably mounted on the second conveying roller shaft 67 substantially at the middle thereof. Two stops 69*a* and 69*b* are located on the same shaft 67 at the opposite sides of the timing pulley 69. The spacing between the stops 69*a* and 69*b* is larger than the thickness of the pulley 69. A washer 69*c* is loosely mounted on the shaft 67 between the right-hand side of the pulley 69 and the right-hand stop 69*b*. Further, a coil spring 69d is located between the washer 69*c* and the right-hand stop 69*b* under compression. Accordingly, the pulley 69 is urged toward the left-hand stop 69*a* through the washer 69*c* under the force of the coil spring 69*d* to form a frictionally pulley holding-slip mechanism (frictional clutch mechanism).

As seen from FIG. 7, a timing pulley 70 is fixedly mounted on the first conveying roller shaft 56 substantially at the middle thereof and opposed to the above timing pulley 69. A timing belt 71 is spanned between the timing pulley 69 and 70.

When the first conveying roller shaft 56 is driven to rotate, the rotation thereof is transmitted to the second conveying roller 68*a* through the pulley 70, belt 71, pulley 69, the above frictional clutch mechanism, second conveying roller shaft 67 and one-way clutch 68*c* in this order so that the roller 68*a* will be rotated in the paper feed direction.

If the rotational load on the second conveying roller 68*a* is above a predetermined level, a slippage will be produced between the pulley 69 of the second conveying roller shaft 67 and the left-hand stop 69*b* and washer 69*c* even if the first conveying roller shaft 56 is driven to rotate. As a result, the pulley 69 rotates on the shaft 67 in lost motion so that the second conveying roller 68*a* will not forcedly be rotated. This provides some advantages as will be described hereinafter.

As seen from FIGS. 7 and 14, a comb-like paper guide plate 73 is swingably mounted at one end on bearing pieces 65*f* each of which is formed as a rearward extension in the respective side board 65*a* or 65*b* of the base 65. The paper guide plate 73 is normally in its operative position in which it contacts the top board 65*c* of the base 65. In such a position, a paper passage leading from the first conveying rollers 57 to the second conveying rollers 68*a* and 68*b* is defined between the top board 65*c* of the base 65 and the paper guide plate 73.

Figure 18:
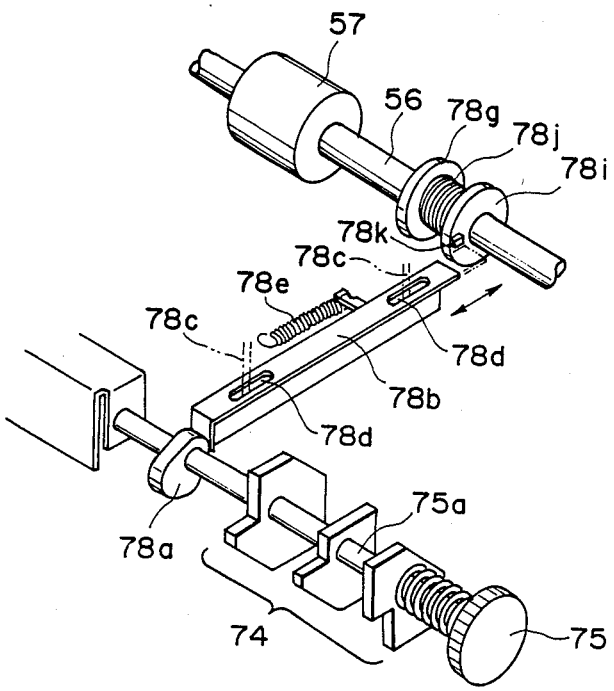
FIG. 18 is a perspective view of a loading mechanism.

As seen from FIGS. 7 and 18, a train of paper size specifying cam plates 74 is disposed in a cavity formed in the forward portion of the base 65. When a dial 75 (FIG. 16) on the outside of the right-hand side board 65*b* of the base 65 is manually operated to set a desired scale 76 thereon at an index 77, a corresponding cam projection is forwardly extended through one of apertures formed in the front board 65*b* of the base 65 to specify the size of paper in a stack placed on the table 5. This dialing must be made prior to the connection of the paper feed device A with the machine body B. When the paper feed device A is connected with the machine body B, the cam projection extended forwardly from the front board 65*d* of the base upon the dialing operation engages one of the paper size detection switches 104 in the machine body B such that the control circuit in the machine body B will be set to operate for the desired paper size.

Figure 19:
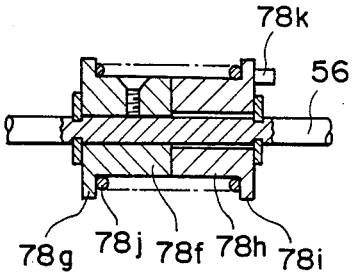
FIG. 19 is an enlarged and longitudinal cross-section of the friction barrel in the loading mechanism shown in FIG. 18.

As seen from FIGS. 7, 18 and 19, there is provided a mechanism 78*a*–78*k* for loading or unloading the first conveying roller shaft 56 in association with the operation of the dial 75. This will be described later.

As seen from FIGS. 6 and 7, first and second sensors S5 and S6 are disposed between the train of first conveying rollers 57 and the train of second conveying rollers 68*a* and 68*b* with the first sensor S5 being located adjacent the train of first conveying rollers 57. These sensors may be microswitches which are supported by the base through slide type supporting members or the like for adjustably positioning the microswitches between the first and second conveying rollers, if required.

Figure 20:
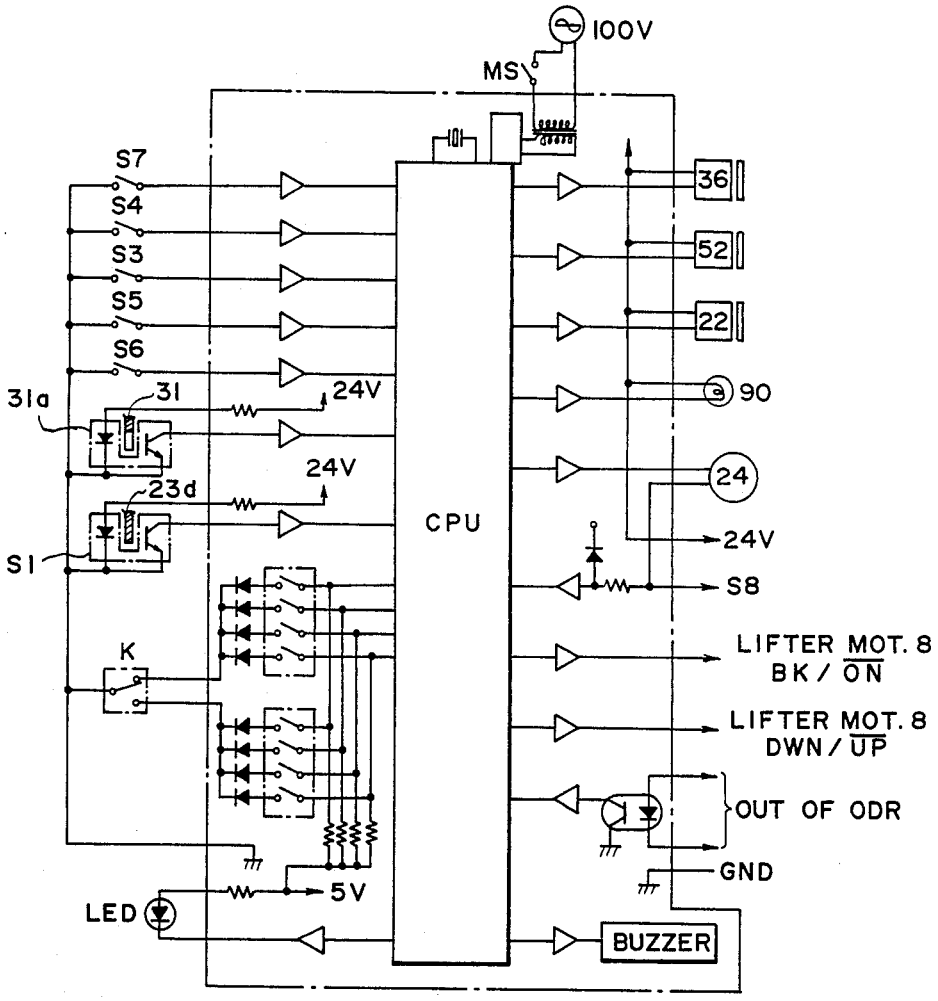
FIG. 20 is a block diagram of a main control circuit.
Figure 21:
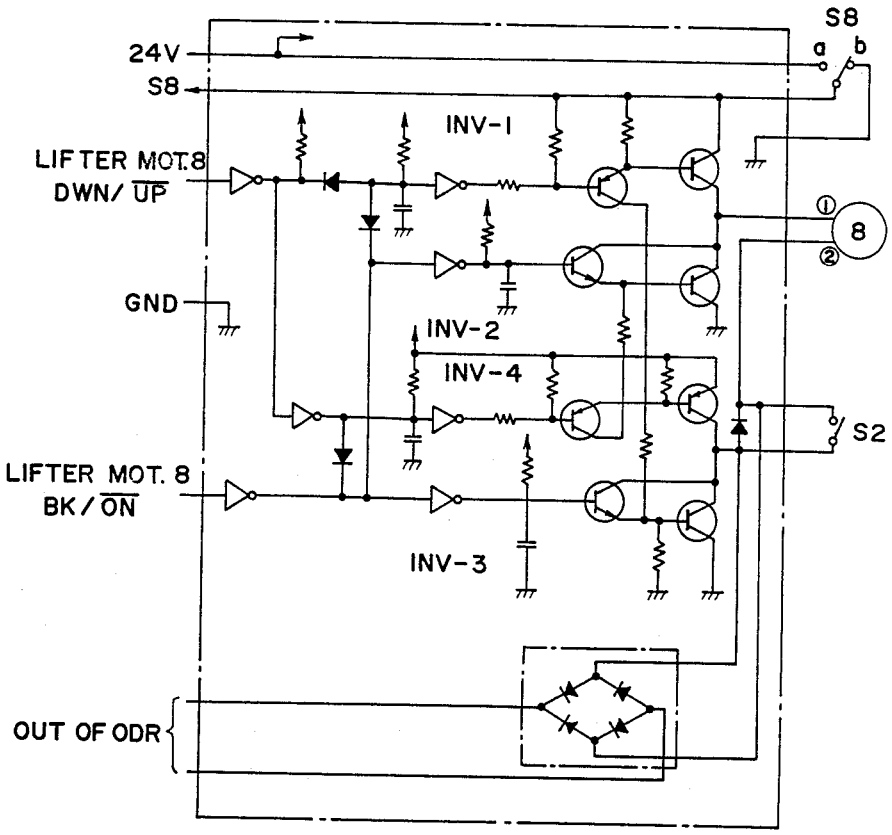
FIG. 21 is a block diagram of a control circuit for the lifter motor.

(5) Control circuit and others:

FIG. 20 is a block diagram of main control circuit while FIG. 21 is a block diagram of a control circuit for the lifter motor 8. These circuits are shown as printed circuit boards 78 and 79 which are held respectively by the outer walls of the side boards 3c and 3d of the chassis as shown in FIGS. 4 and 5. The other components such as transformers are disposed as on the bottom board 3a of the chassis, but herein omitted for clarification.

As seen from FIGS. 6 and 7, the front and side boards 3b, 3c and 3d are covered by style strips 80, 81 and 82 which are detachably mounted thereon. The opened top of the chassis can be closed by a lid 83 which is pivotably connected with a pivot shaft 84 as shown in FIGS. 4 to 6.

A box-like door 85 is pivoted to a vertical hinge 85a (FIGS. 5 and 7) on the rearward edge of the left-hand side board 3d of the chassis to close the opened back of the chassis. The door 85 is made of a transparent or transparent colored synthetic resin material such that the stack of paper on the table can be observed through the door when it is closed.

As seen from FIGS. 1, 8 and 9, main switch MS and indicator lamp LED are located on the top face of the stype strip 81 on the side board 3c of the chassis.

As seen from FIGS. 1 and 4, a joint switch S7 is disposed on the forward portion of the side board 3c of the chassis for detecting the connection of the paper feed device A with the machine body B. When the paper feed device A is connected with the machine body B and the positioning pins 116 on the frame D enter the positioning holes 116a on the paper feed device A, one of the positioning pins 116 engages the joint switch S7 to hold it in its ON position. Thus, the connection of the paper feed device A with the machine body B is known by the control circuit.

As seen from FIGS. 1, 4, 7, 8 and 9, a door switch S8 is supported by the rearward portion of the right-hand side board 3c of the chassis through a swinging lever 89. As the door 85 is closed, a projection 85b on the door engages the door switch S8 to hold it in its ON position. When the door 85 is opened, the door switch S8 is turned off. Signals from the door switch S8 are supplied to the input of the control circuit. However, the door switch S8 is positioned such that the projection 85a on the closed door 85 is actuated by the projections 83a on the style strip 81 and the lid 83 (the projection 83a on the stype strip 81 being not shown) only when the style strip 81 is mounted on the right-hand side board 3c of the chassis and the lid 83 is closed. If the stype strip 81 is removed and/or the lid 83 is opened, the door switch S8 is positioned out of the door projection 85b so that the door switch S8 will never be turned on, as shown by two-dot chain line in FIG. 4.

As seen from FIGS. 6 and 7, a lamp 90, which is used as a source of light, is located within the base 65 of the one-paper conveying and holding section 2 at a position opposed to a light receiving element CdS (FIGS. 1 and 15) for detecting the absence of paper which is disposed on the inner and bottom wall of the cassette insertion opening 101 of the machine body B. If this lamp 90 is lighted on, the light therefrom is incident on the light receiving element CdS through an aperture in the bottom wall of the base 65 and an aperture in the bottom wall of the cassette insertion opening 101.

As seen from FIGS. 7–9, a movable side plate 86 is adjustable mounted on the inner wall of the left-hand side board 3d of the chassis through a bracket 87. The movable side plate 86 is laterally moved to change the distance between the movable side plate 86 and a stationary reference side plate 88 on the inner wall of the right-hand side board 3c of the chassis, depending on the size of paper in the stack on the table 5. Sheets of paper are placed as a stack on the table 5 between the movable side plate 86 and the stationary reference side plate 88 with the leading face of the stack being engaged by the inner wall of the front board 3b of the chassis.

The table 5 is divided into two forward and rearward plates 5d and 5e as shown in FIGS. 6 and 7. The rearward plate 5e is detachably mounted on the forward plate 5d.

Figure 22:
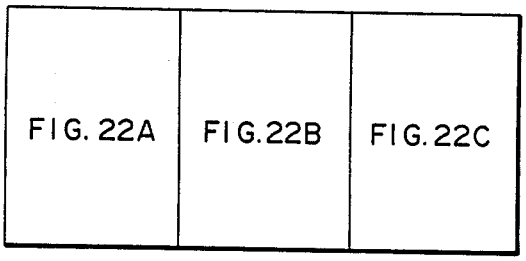
FIG. 22, including
Figure 23:
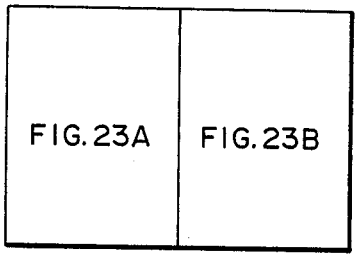
FIG. 23, including
Figure 24:
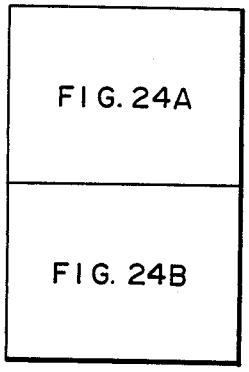
FIG. 24, including
Figure 22A:
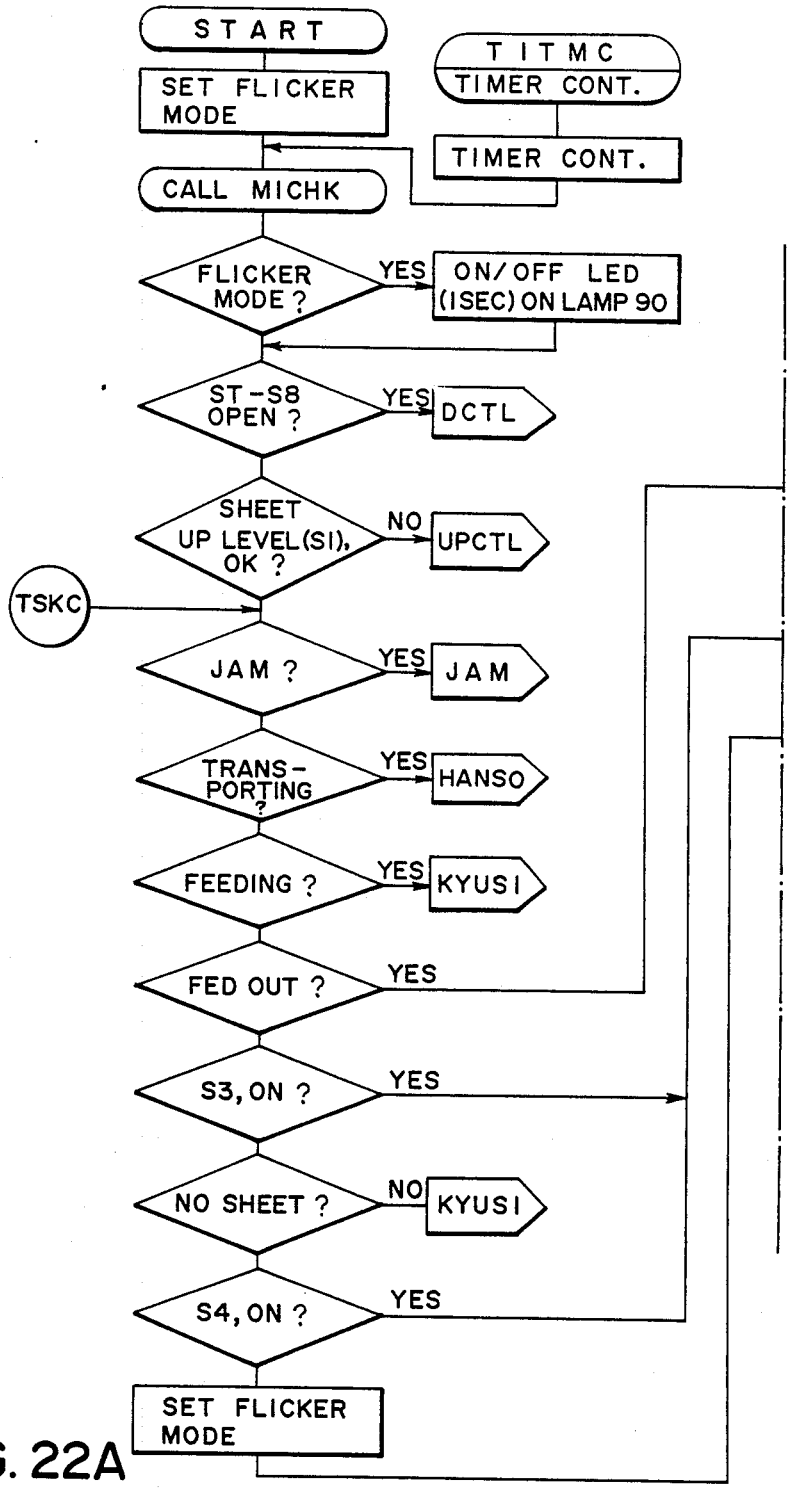
FIGS. 22A, 22B, and 22C, is a flow chart of the entire operation of the paper feed apparatus.
Figure 22B:
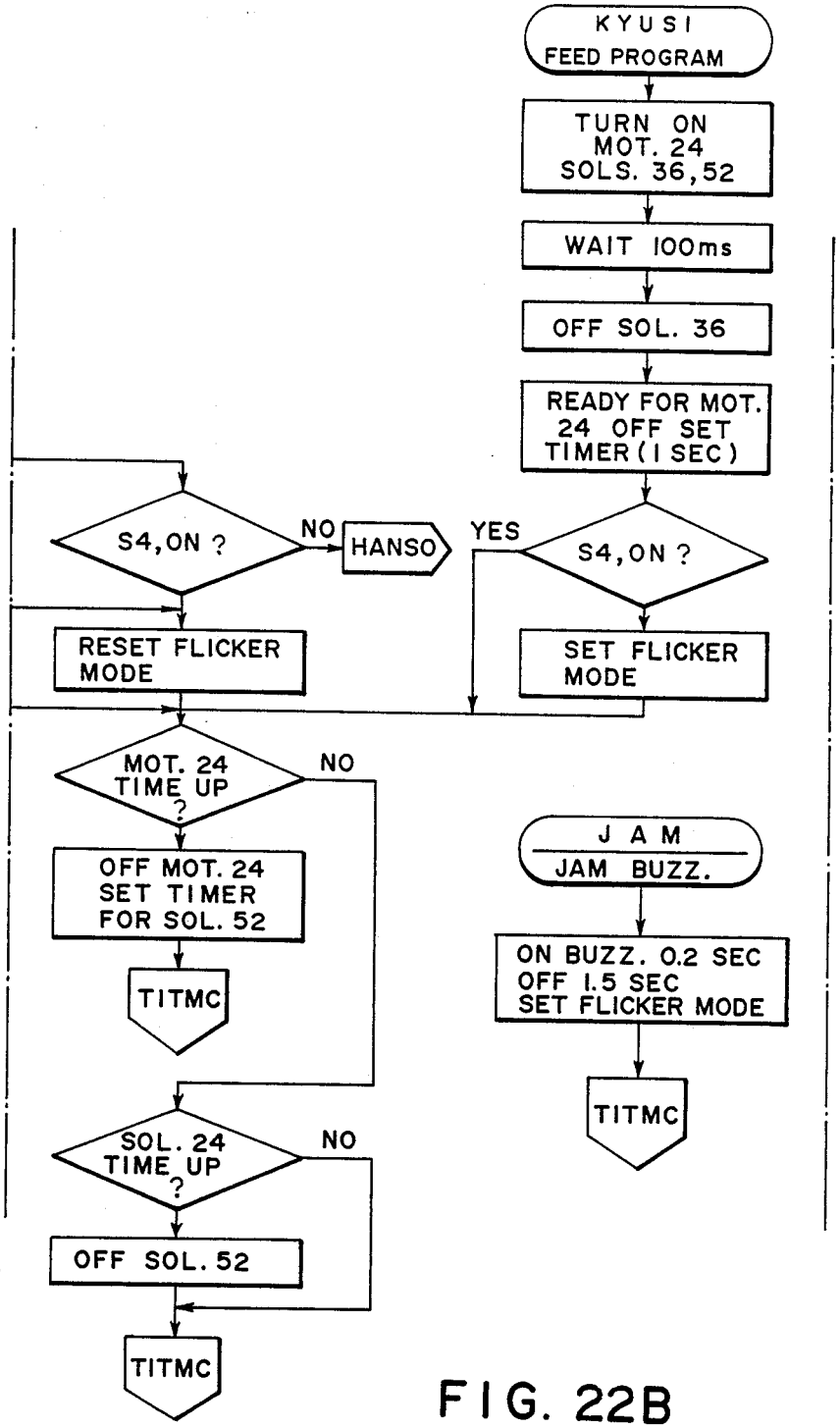
Figure 22C:
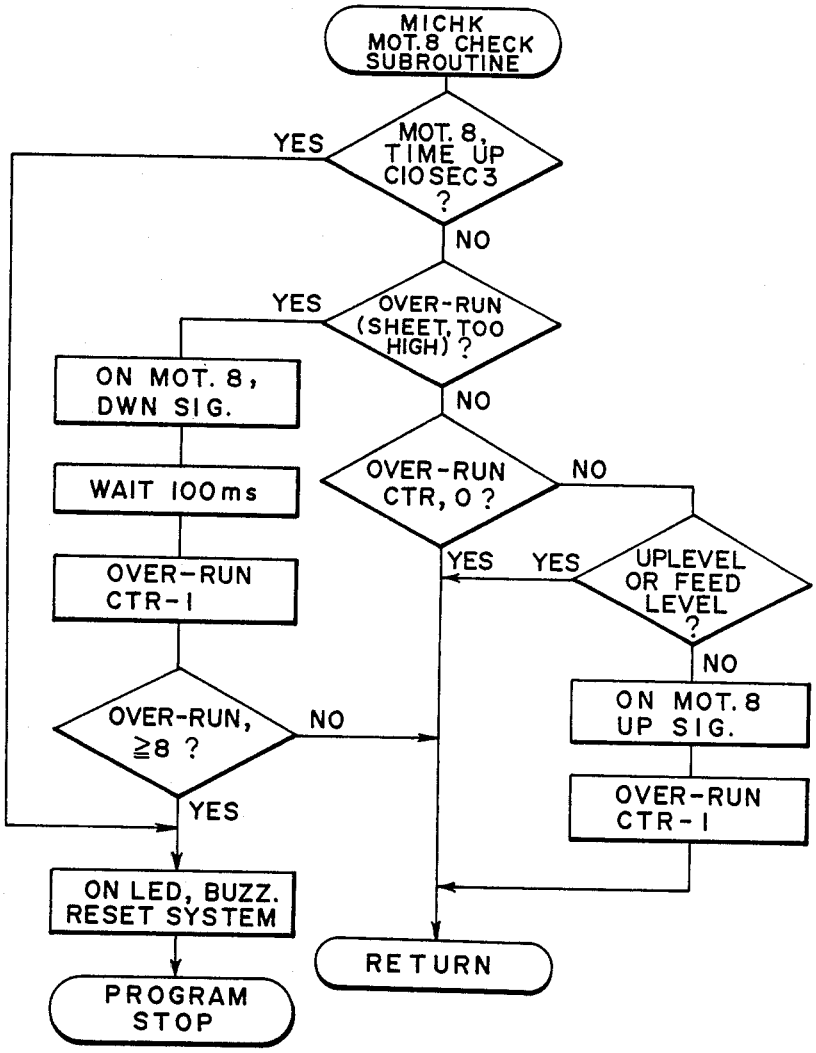
Figure 23A:
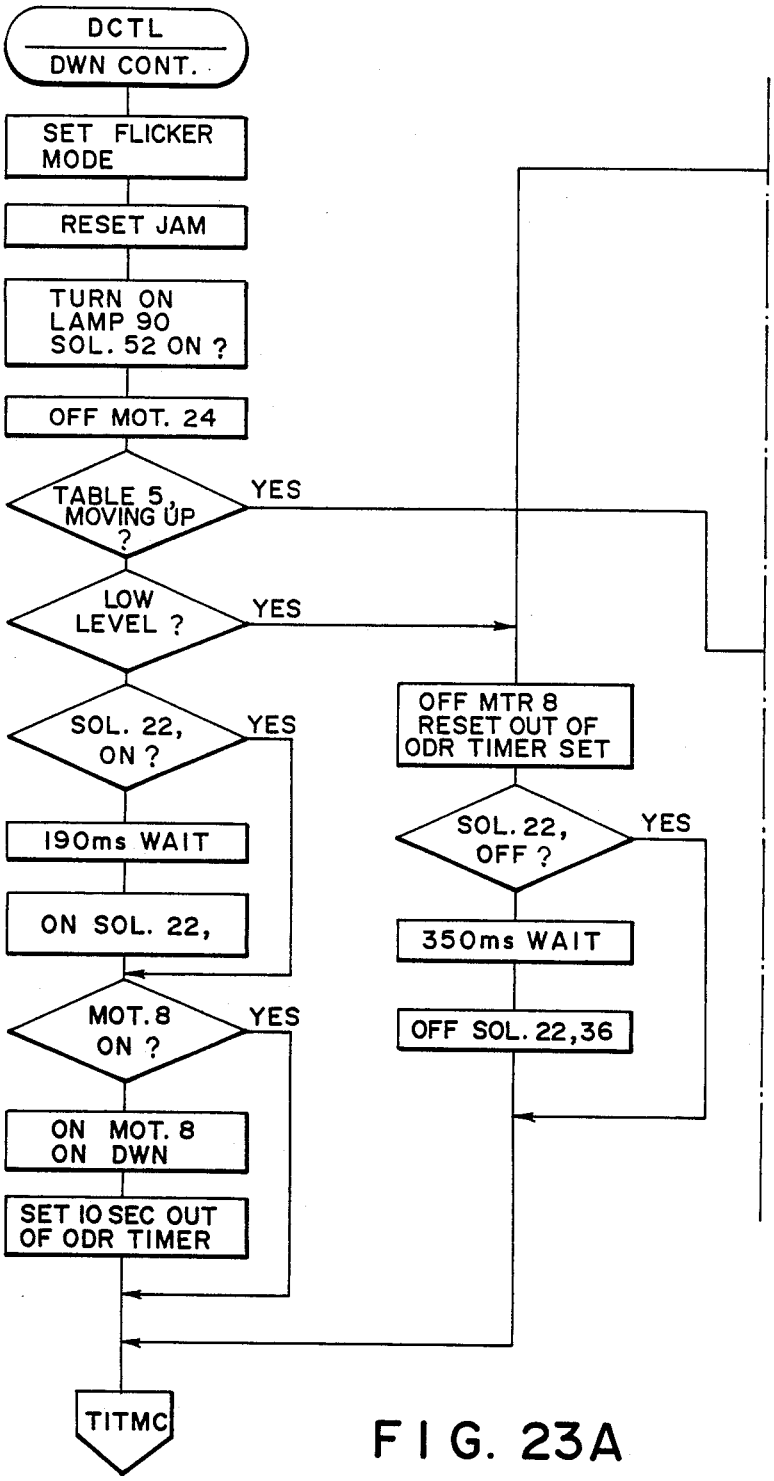
FIGS. 23A and 23B, is a flow chart of the operation of the vertically movable paper-containing table.
Figure 23B:
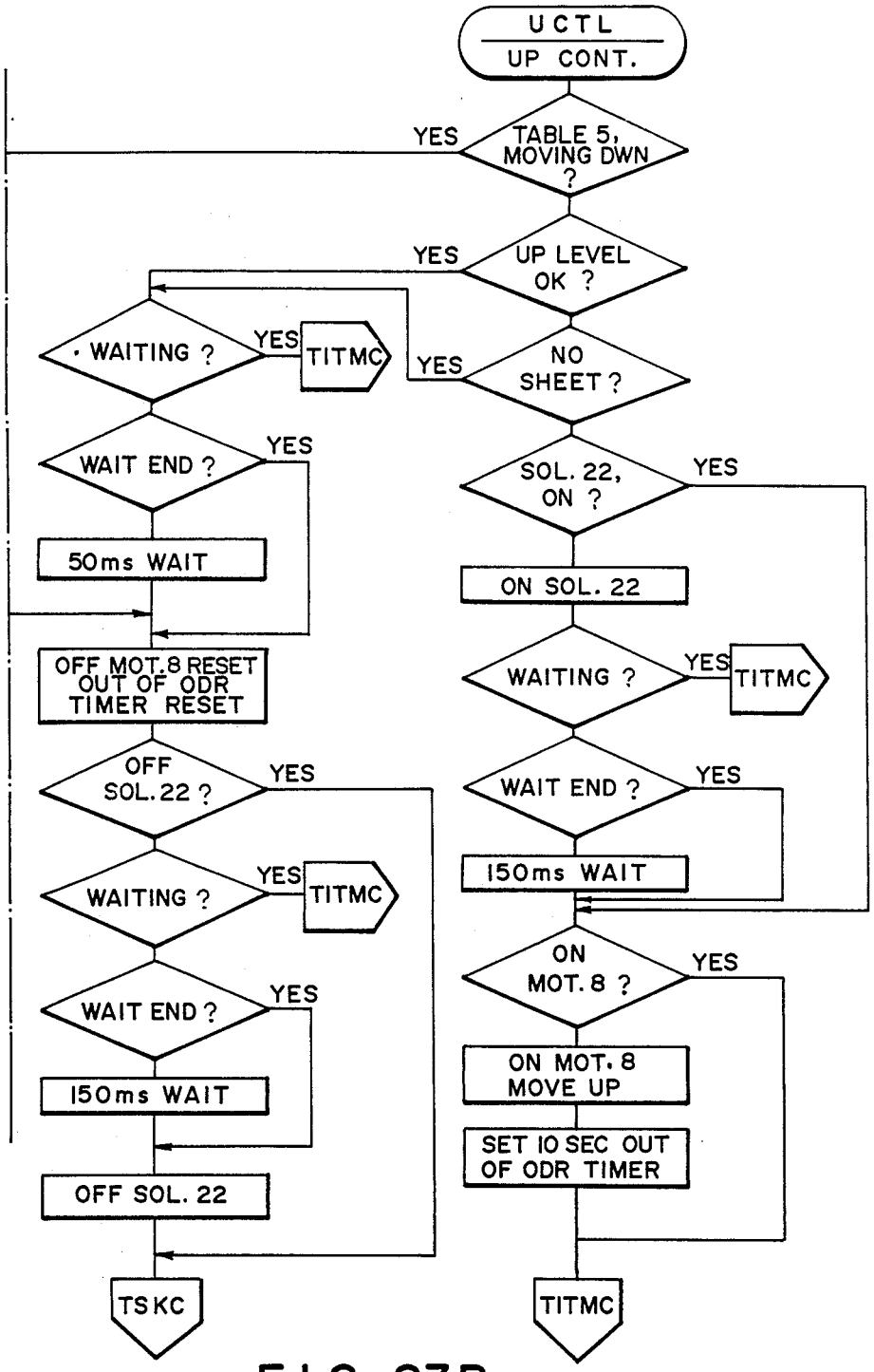
Figure 25:
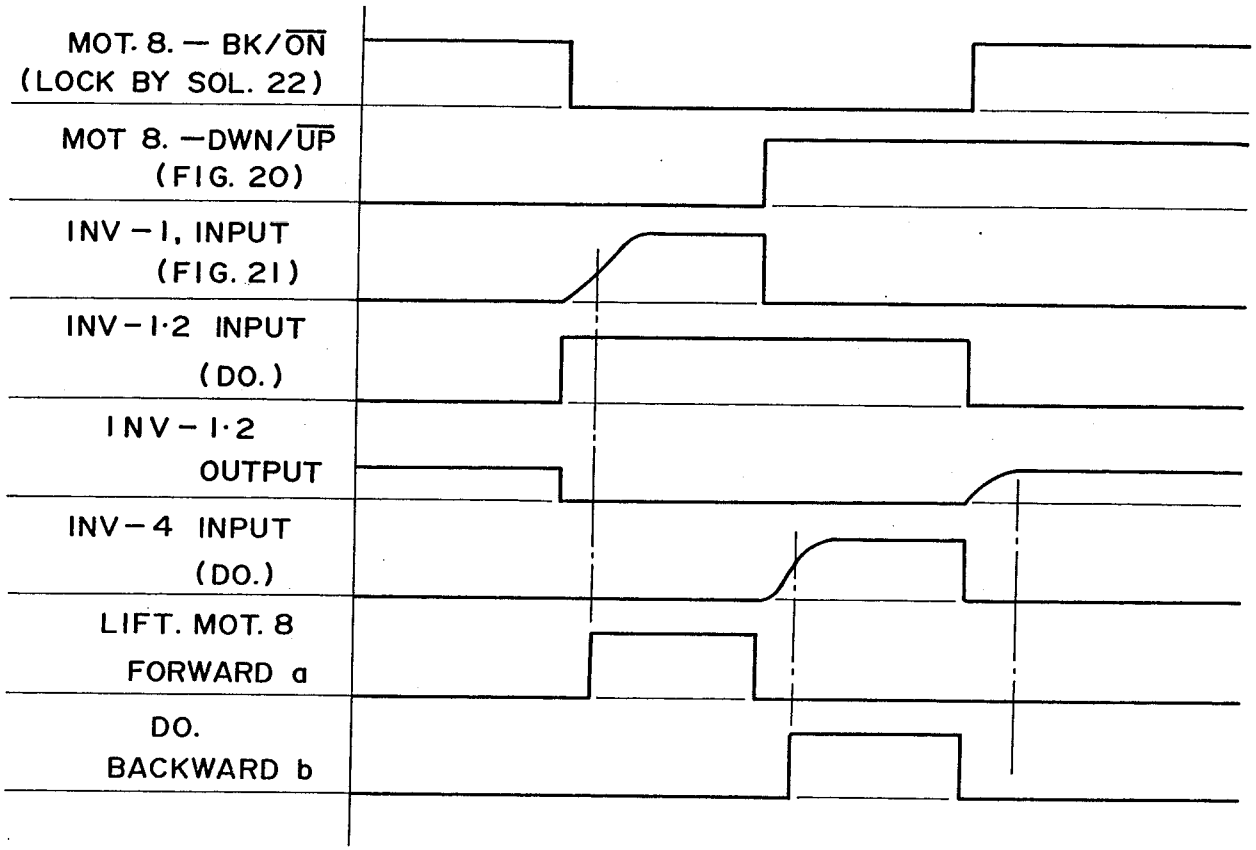
FIG. 25 is a timing chart of the lifter motor.

(6) Operation (sequence):

FIG. 22 is a flow chart of the entire operation of the system; FIG. 23 is a flow chart mainly showing the operation of the vertically movable paper containing table mechanism; FIG. 24 is a flow chart of the operation of the one-sheet feeding, conveying and holding mechanism; and FIG. 25 is a timing chart of the lifter motor 8.

(a) The paper feed device A is first mounted on the rails 113 of the frame D which has been attached to the machine body B, in such a manner as described hereinbefore. The size selecting dial 75 is then operated to set the scale 76 corresponding to the size of paper to be used. Subsequently, the device A is connected with the machine body B.

At this time, the joint switch S7 is turned on. The control circuit in the machine body B receives a signal from that switch 104 which is selectively actuated by the corresponding cam plate 74 selected by the dial 75.

Subsequently, the main switch MS is manually turned on to flash the indicator lamp LED and to energize the lamp 90 for indicating the absence of paper. The light from the lamp 90 is incident on the light receiving element CdS in the machine body B.

(b) When the door 85 is opened to set the stack of paper, the door switch S8 is turned off to generate a signal which is in turn utilized to energize the electromagnetic attracting device 22 of the lifter motor 8. As a result, the pawl plate 21 is disengaged. Thereafter, the motor 8 is energized to rotate in the opposite direction. Therefore, the table 5 is downwardly moved. Upon the downward movement of the table 5, the projection 5c on the table 5 engages the position sensor S4 to turn on. The lifter motor 8 is deenergized by the signal from the position sensor S4. After the motor has completely stopped, the electromagnetic attracting device 22 is deenergized to engage the pawl plate 21 with the motor 8. The table 5 is stopped and held at its lowermost position.

If the remaining sheets of paper on the table 5 is different in size from sheets of paper which are to be used, they are removed from the table 5. The addition, the lid 83 is opened to reset the movable side plate 86 to be compatible with the sheets of paper to be used. Subsequently, a stack of about 2000 sheets is placed on the table 5, for example.

(c) Thereafter, the lid 83 is first closed and the door 85 is then closed. The door switch S8 is therefore turned on to energize the electromagnetic attracting device 22 of the lifter motor 8 which is in turn disengaged. Then, the motor is energized to rotate in the forward direction so that the table 5 will be moved upwardly.

(d) Upon the upward movement of the table 5, the top of the stack P will reach the lower limit PL. At this time, the optical path of the sensor S1 is blocked by the fourth upward projection 23d on the lever 23. After a predetermined time period during which the top of the stack P reaches the upper limit PH, the motor 8 is deenergized. After the motor 8 has completely stopped, the electromagnetic attracting device 22 is deenergized. The table 5 is stopped and held at its raised position.

(e) At this time, if the first paper sensor S5 detects the absence of paper in the paper conveying path, the paper feed program in the control circuit is executed to energize the conveying motor 24. Simultaneously, the first electromagnetic attracting device 36 is energized in a moment to engage the one-revolution clutch 34 so that the paper feeding roller support shaft 33 is rotated through one revolution. While the first electromagnetic attracting device 36 is being energized, the second electromagnetic attracting device 52 also is energized.

Therefore, the feed rollers 40 are rotated during the rotation of the paper feeding roller support shaft 33 through one revolution. If the second paper sensor S6 detects the absence of paper, the second electromagnetic attracting device 52 is deenergized. The clutch 50 is thus engaged to rotate the first and second conveying rollers 57 and **68*a*** in such a manner as described hereinbefore.

When the feed rollers 40 are rotated, the topmost sheet of in the stack P is fed out beyond the forward separation pawls 45 to between the first conveying rollers 57 and the driven pressure rollers 59 and relayed there. Thereafter, the sheet is moved to the forward portion of the base 65 of the one-sheet conveying and holding section 2 through the conveying path defined between the top board **65*c* of the base 65 and the comb-like paper guide plate 73**.

Meanwhile, the feed rollers 40 are stopped, but the fed sheet continues to be conveyed by cooperation of the first conveying rollers 57 with the pressure rollers 59. After the feed rollers 40 have been disconnected from the drive, they continue to idle on the shaft through the one-way clutch 41 by the movement of the conveyed sheet. This reduces the possible resistance which could be produced when the sheet is being conveyed.

(f) When the sheet enters the passage between the top board **65*c* of the base 65 and the guide plate 73, it is first sensed by the first sensor S5 and then by the second sensor S6. Thereafter, the leading edge of the sheet is caught between the second conveying roller 68*a* and the idle roller 103*a* of the feed roller 103 in the machine body B which contacts the second conveying roller 68*a* and then passes through between the roller 68*a* and the idle roller 103*a* and between the second conveying rollers 68*b* rotatably mounted on the shaft 67 and the idle rollers 103*a* opposed to these rollers 68*b* to provide very small gap, without any interruption. When the leading edge of the sheet reaches a reference line 0-0 (FIGS. 7 and 14) adjacent the forward edge of the base 65, the first conveying rollers 57 and the second conveying roller 68*a*** associated therewith are disconnected with the drive to stop the conveying operation of the sheet.

The disconnection of the first and second conveying rollers 57 and **68*a* with the drive is accomplished in accordance with the following procedure: When the leading edge of the conveyed sheet is detected by the first sensor S5 and then by the second sensor S6, the signals therefrom are used to initiate the count of pulses in cooperation of the encoder toothed disc 31 being rotated with the photoelectric element 31*a* (FIG. 13). When a predetermined number of pulses has been counted, the second electromagnetic attracting device 52 is energized to engage the pawl arm 52*a* with the outer toothed ring 51 of the clutch 50** to disengage the latter.

The number of pulses is predetermined in dependence on the speed of the sheet, the distance between the second paper sensor S6 and the reference line 0-0, and the distance of the conveyed sheet movement by the inertial rotation of the rollers 57 and **68*a*** after they are disconnected with the drive. This value is pre-set in the control circuit and may be changed if required.

After the leading edge of the conveyed sheet has been detected by the second paper sensor S6, the no-sheet indicating lamp 90 is lighted off and the indicator lamp LED is changed from its flashing mode to its steadily glowing mode.

After the conveyed sheet has been stopped with the leading edge thereof being positioned at the reference line 0-0, the sheet is held at this position until the feed rollers 103 in the machine body B initiate to rotate in accordance with the sequence program in the machine body B. If the conveyed sheet in short, the trailing edge of the held sheet is positioned between the feed rollers 40 and the first conveying rollers 57. If the sheet is long, the rearward part of the sheet remains below the feed rollers 40. In any event, the sheet can be sensed by the first and second sensors S5 and S6 in its standby position so that these sensors are maintained at their ON position.

If another sheet of paper is not fed by the feed rollers 103 in the machine body B during a predetermined time period after the previous sheet has been held in its standby position, that is, a period at least over the time until the another sheet of paper is supplied in the continuous copying mode (for example, about one or two seconds), the conveying motor 24 in the paper feed device A is deenergized and the second electromagnetic attracting device 52 also is deenergized at the time that the motor 24 is completely stopped (about two seconds). This saves the electric power.

(g) As driving of the feed rollers 103 in the machine body B is initiated in accordance with the sequence program, the sheet is moved from is standby position in the paper feed device A to the machine body B by the nip between the second conveying rollers **68*a* and 68*b* and the feed rollers 103**.

At this time, none of the feed rollers 40 and the first and second conveying rollers 57 and **68*a* are positively driven. Since they are respectively mounted on the support shafts 39, 56 and 67 through the respective one-way clutches 41, 58 and 68C, these rollers are freely rotated by the movement of the sheet due to the drive of the feed rollers 103** in the paper feed device A. This reduces the possible resistance which could be produced when the sheet is being conveyed.

(h) When the trailing edge of the sheet is detected by the first paper sensor S5, the latter generates a signal which is in turn used to energize the conveying motor 24 if it has been stopped. If the second electromagnetic attracting device 52 has been deenergized, it is again energized to maintain the clutch 50 at its disengagement position. Subsequently, the first electromagnetic attracting device 36 is instantaneously energized to engage the one-revolution clutch 34 so that the feed rollers 40 are driven to rotate during the rotation of the paper feed roller support shaft 33 through one revolution.

When the feed rollers 40 begins to rotate, a next sheet of paper is fed out of the top of the stack P on the table 5. The leading edge thereof is received by the nip between the first conveying rollers 57 and the driven rollers 59 to provide some amount of loop in the sheet between the first conveying rollers 57 and the feed rollers 40 until the feed rollers 40 stop rotating.

When the trailing edge of the previous sheet has passed at the second paper sensor S6, the latter is turned off to generate a signal which is in turn used to deenergize the second electromagnetic attracting device 52 and then to engage the clutch 50 so that rotation of the first and second conveying rollers 57 and 68*a* is initiated. Thus, the succeeding sheet runs after the preceding sheet and is conducted into the conveying passage between the top board 65C of the base 65 and the comb-like paper guide plate 73.

As the leading edge of the succeeding sheet passes the second paper sensor S6, the latter is turned off to generate a signal which is in turn used to initiate the pulse counting operation in the encoders 31 and 31*a*. If the predetermined number of pulses have been counted, the second electromagnetic attracting device 52 is energized to disengage the clutch 50 so that the succeeding sheet will be stopped and held with the leading edge thereof being positioned at the reference line 0-0. The trailing edge of the preceding sheet is removed from between the second conveying rollers 68*a* and 68*b* and the idle rollers 103*a* of the feed rollers 103 in the machine body B before the leading edge of the succeeding sheet enters therebetween.

In the case where the preceding sheet is fed into the machine body B by the paper feed means 103 at such a relatively high speed that the trailing edge of where preceding sheet has already reached the second sensor S6 when the leading edge of the succeeding sheet reaches the fitst conveying rollers 57 by the rotation of the feed rollers 40 which are driven by a signal from the first paper sensor S5 which detects the trailing edge of the preceding sheet, the succeeding sheet is subsequently conveyed by the first conveying rollers 57 without the formation of any loop.

(i) The succeeding sheet is introduced from its stand-by position to the machine body B by the re-rotation of the feed rollers 103 in the machine body B.

(j) Each time that the feed rollers 103 in the machine body B are driven to rotate, the above steps (g), (h) and (i) will automatically be repeated in the paper feed device A.

(k) For example, if 20–30 sheets of paper have been fed out of the stack P on the table 5, the top of the stack P is in the lower limit level PL. This is detected by the level sensor S1 so that the table 5 will be moved upwardly and then stopped after a predetermined time period. At this time, the top of the stack P is substantially in the upper limit PH. Even during the upward movement of the table 5, the paper feed mechanism is actuated to feed a sheet of paper from the top of the stack P to the holding section 2 each time that the previous sheet is fed from its stand-by position to the machine body B by the rotation of the feed rollers 103.

In this manner, each time that the stack is decreased in height to the lower permissible limit PL, the table 5 can automatically be moved upwardly. The top level of the stack P is maintained within the range of PH to PL until there is no sheet on the table 5.

Thus, a great number of paper sheets, for example, 2000 sheets on the table 5 can continuously be fed to the machine body B as long as the image forming system continues to be operated.

Even if the speed of the rotating feed rollers 103 in the machine body B is changed due to the variations of magnification or others and even if an image forming system with which the paper feed device A is connected is different in speed, the preceding sheet is necessarily conveyed being spaced away from the succeeding sheet. There is therefore no trouble due to the overlapping of the succeeding sheet with the preceding sheet.

(1) If the top face of the table 5 itself is moved beyond the upper limit level PL, the projection 5C on the table 5 contacts the position sensor S3 to turn on. A signal is supplied from the sensor S3 to the input of the control circuit. Thereafter, if the last sheet is fed from the table 5, the lever 23 is pivoted to the maximum inclination $\alpha$LL to open the optical path in the sensor S1. A signal is supplied from the sensor S1 to the input of the control circuit. When the last sheet is first held at its stand-by position and then conducted to the machine body B, the first sensor S5 or the first and second sensor S5 and S6 are turned off so that the no-paper indicating lamp 90 will be lighted and the indicator lamp LED will be lighted in its flashing mode.

When the no-paper indicating lamp 90 is turned on, the light therefrom is incident on the light receiving element CdS in the machine body B to actuate a warning circuit for indicating the absence of paper on the table 5. Simultaneously, the entire mechanism may automatically be stopped.

(m) Thus, the door 85 of the paper feed device may be opened for re-supplying the sheets of paper. As in the step (b), the table 5 has been automatically moved downwardly to the lowermost level. Therefore, a new stack of paper may be placed on the table 5. If the door 85 is closed, the sequence in the steps (c) through (h) is again executed.

(7) Emergency:

If the top of the stack is beyond the upper permissible level PH because the table 5 continues to be moved upwardly due to any abnormal cause such as jamming or the like, the lever 23 is over-pivoted with the third upward projection 23*c* contacting the sensor S2 to detect the over-movement of the table 5. A signal from the sensor S2 is utilized to energize the lifter motor 8 in the reverse direction so that the table 5 will be moved downwardly. When the top of the stack P on the table 5 is moved to the lower limit PL, this is detected by the sensor S1. When the top face of the table 5 is moved below a predetermined lower level, this is detected by the sensor S3. As a result, the lifter motor 8 is shifted to rotated in the forward direction so that the table 5 is again moved upwardly for a predetermined time period. Upon this downward and upward movement of the table 5, the abnormal cause can naturally be removed. When the top of the stack P is within the range of PH–PL by the action of the lever 23 and sensor S1 so that the table 5 will be stopped at its raised position, it is judged by the control circuit that the abnormal cause has been removed. If the abnormal cause is not still removed by the first downward and upward movement of the table 5 and when the sensor S2 continues to be actuated, several downward and upward movements of the table 5 are repeated. If the abnormal cause is not removed even by a preset number of such movements, the control circuit judges it to be a failure in the system itself and then makes the paper feed device A inoperative while at the same time actuating a warning buzzer to inform the failure to an operator.

If the top of the stack P on the table 5 is over-moved upwardly by the wrong operation of the sensor S2 due to any disturbance of the sheets in the stack P or such other causes that can naturally be removed by one or more downward and upward movements of the table 5 within a certain range, these abnormal causes can be removed under the operational sequence so that the paper feed device A will automatically be restored to its normal operation without actuation of the warning buzzer.

If the level sensor S1, level sensor S3 or level sensor S4 is not actuated past a predetermined timer time after the upward or downward movement of the table 5 has been initiated, a failure in the system is judged by a lifter motor failure check sub-routine of the control circuit. In this case, the paper feed device A is made inoperative and at the same time the warning buzzer is actuated.

(8) Friction clutch mechanism (FIGS. 7 and 17):

The aforementioned friction clutch mechanism 69*a* to 69*d* is interposed between the second conveying roller shaft 67 and the timing pulley 69 driving the shaft 67 in order to remove the following trouble.

Due to jamming, wrong operation and the other undesirable matters, the feed rollers 103 in the machine body B may stop while directly contacting the second conveying roller 68*a* with no paper therebetween. In such a case, the second conveying roller 68*a* is downwardly biased against the force of the leaf spring 67*b* by an amount larger than that at the time that the roller 68*a* contacts the idle roller 103*a*. Therefore, the roller 68*a* is engaged by the feed roller 103 with an increased force of the leaf spring 67*b*. If the second conveying roller 68*a* is forcedly rotated against the increased bias between the roller 68*a* and the feed roller 103 in such a condition, the material may be scraped off from the outer periphery of the feed roller 103. In accordance with the present invention, the second conveying roller shaft 67 is driven to rotate through the friction clutch mechanism 69*a*–69*d* as described above. In the above condition, therefore, the second conveying roller 68*a* cannot forcedly be rotated due to a slippage produced at the pulley 68 if the roller 68*a* is under an increased load. The friction clutch mechanism may be adjusted by suitably selecting or regulating the coil spring 69*d* with respect to its spring constant.

(9) Loading mechanism (FIGS. 7, 18 and 19):

A loading mechanism 78*a*–78*k* will now be described which loads or unloads the first conveying roller shaft 56 in association with the operation of the paper size selecting dial 75.

Load to which the first and second conveying rollers 57 and 68*a* are subjected in the paper conveying process varies for paper sheets of different sizes, sheets of size B5 or A4 which are transversely and sheets of size B4 which are longitudinally fed.

In accordance with the present invention, the feed rollers 40 are mounted on the shaft 39 through the one-way clutches 41. After these rollers 40 have been disconnected with the drive, they are adapted to rotate on the shaft 39 in lost motion when a sheet is forwardly moved by the first and second conveying rollers 57 and 68*a* under the feed rollers 40. As a result, a resistance on conveying the sheet is of very small value but not zero. This is because of the bias and rotational resistance in the feed rollers 40.

If a sheet of a relatively small size is conveyed by the first conveying rollers 57, it is slightly conveyed with no loading after the trailing edge thereof has passed the feed rollers 40. Thereafter, the sheet continues to be conveyed until the first and second conveying rollers 57 and 68*a* are stopped through the clutch 50 disengaged when a predetermined number of pulses have been counted by the encoders 31 and 31*a*.

For a sheet of a relatively large size, however, it is stopped under the load of the feed rollers 40 since the trailing edge of the sheet is still positioned under the feed rollers 40 when the first and second conveying rollers 57 and 68*a* have been stopped.

Briefly, the load is smaller for the sheet of smaller size and larger for the sheet of larger size. If the number of pulses to be counted is set for a sheet of smaller size in the encoders 31 and 31*a* such that the sheet is stopped with the leading edge thereof being coincident with the reference line 0-0, a sheet of larger size may be stopped under the above larger load before the leading edge thereof reaches the reference line 0-0. Conversely, if the number of pulses to be counted is set for the sheet of larger size, the sheet of smaller size may be stopped under the reduced load with the leading edge thereof overrunning the reference line 0-0.

When the sheet is stopped with the leading edge thereof being ahead of the reference line 0-0 and if that sheet is fed into the machine body B by the feed rollers 103, there will be produced some delay in the image forming process. Conversely, when the sheet is stopped with the leading edge thereof overrunning the reference line 0-0 and if that sheet is fed into the machine body B, there will be formed an excess loop in the sheet adjacent the timing roller in the machine body B. This leads to jamming.

The loading mechanism eliminates the above problem. In FIGS. 7, 18 and 19, numeral 78*a* denotes a cam fixedly mounted on the shaft 75*a* of the paper size selecting dial 75 and numeral 78*b* designates a movable rod including elongated slots 78*d* through which pins 78*c* on the inner wall of the top board of the base 65 extend upwardly. The movable rod 78*b* is urged toward the cam 78*a* under the force of a tension spring 78*e*. If the enlarged diameter of the cam 78*a* engages the end of the movable rod 78*b* when the dial 75 is operated, the movable rod 78*b* is rearwardly moved against the force of the spring 78*e*. If the reduced diameter of the cam 78*a* engages the end of the rod 78*b*, the latter is forwardly moved under the force of the spring 78*e*. In the illustrated embodiment, if the B4 scale (larger size) on the dial 75 is set at the index 77, the movable rod 78*b* is in its forward position. If the A4 or B5 scale (smaller size) on the dial 75 is set at the index 77, the movable rod 78*b* is held at its rearward position.

Numeral 78*f* denotes a coil spring-wound barrel fixedly mounted on the first conveying roller shaft 56 and having a flange 78*g* formed thereon at the leftward end; 78*h* another coil spring-wound barrel loosely mounted on the shaft 56 adjacent the first barrel 78*f* and having a flange 78*i* formed thereon at the rightward end; 78*j* a coil spring wound around both the barrels 78*f* and 78*h* to provide a suitable tightening force; and 78*k* a latching pawl formed outside on the flange 78*i* of the barrel 78*h*.

When the movable rod 78*b* is held in its forward position, the rearward end of the movable rod 78*b* is retracted away from the latching pawl 78*k* so that the barrels 78*f*, 78*h* and coil spring 78*j* are rotated with the shaft 56 as a unit by the rotational movement of the first conveying roller shaft 56. If the movable rod 78*b* is in its rearward position, the rearward end thereof is in the path of the latching pawl 78k so that the rightward barrel 78h will be prevented from rotating by the engagement of the rearward end of the rod 78b with the latching pawl 78k when the first conveying roller shaft 56 is driven to rotate. Therefore, the shaft 56 will be rotated with a slippage between the barrel 78h and the coil spring 78j. This slippage acts on the shaft 56 as a rotational load.

Suppose that the number of pulses to be counted is set for a sheet of larger size in the encoders 31 and 31a such that the sheet is stopped with the leading edge thereof being coincide with the reference line 0-0. If the scale of B4 which is for larger size is set by the dial 75, the rearward end of the movable rod 78b is retracted away from the rightward barrel 78h so that the first conveying roller shaft 56 is not subjected to the aforementioned load. Therefore, the sheet may be stopped with the leading edge thereof being coincide with the reference line 0-0.

If the scale of A4 or B5 is set by the dial 75, the rearward end of the movable rod 78b is moved to latch the rightward barrel 78h so that the shaft 56 will be subjected to the above rotational load. As a result, the rotational load prevents the sheet of smaller size from overrunning as in the load produced at the time that the sheet of larger size is conveyed by the feed rollers 40.

As be understood frm the foregoing, a sheet of any size can be stopped with the leading edge thereof being coincident with the reference line 0-0 by loading the first conveying roller shaft 56 for a sheet of smaller size and unloading the shaft 56 for a sheet of larger size.

The rotational load may be adjusted by regulating the tightening force in the coil spring.

The present invention may utilize any electrical means in which two set numbers of pulses to be counted in an encoder circuit can be selected by actuating a switch k (FIG. 20) under the rotation of the cam 78a of the dial 75.

(10) The others:

In the vertically movable paper-containing table mechanism, the sprocket 17 (FIGS. 4 and 7) is mounted on the shaft 12 through the one-way clutch 16. If the paper feed device A should be inspected or repaired, the joint switch S7 is manually turned on and the door 85 is then opened so that the door switch S8 is turned off to downwardly move the table 5. Even if the hand of an operator or other external matter is accidentally placed between the downwardly moving table 5 and the bottom board 3a of the chassis, the sprocket 17 rotates on the shaft 12 in lost motion through the one-way clutch 16 under the reverse driven of the motor 8 so that the table 5 cannot forcedly be moved downwardly without damaging of the hand of the operator or external matter. This also prevents the motor 8 from being overloaded.

If the conveying section 2 forwardly extending from the large-sized paper-containing section 1 is adapted to pivot downwardly about the shaft 56 to its substantially vertical and downward position over the front board when the paper feed device A is not used, the entire apparatus is compacted and conveniently stored.

While the invention has been described with reference to the structures disclosed herein, it is not confined to the details set forth and this application is intended to cover such modifications or changes as may come within the purposes of the improvements or the scope of the following claims.

What is claimed is:

1. A paper feed unit cooperable with an image forming apparatus, comprising:

a table for supporting thereon a stack of cut sheets;

a cut sheet conveying section adapted to be set to a sheet receiving portion formed in the image forming apparatus and adapted to cooperate with a feeding means of the image forming apparatus;

a cut sheet feed mechanism for feeding the cut sheets from the stack on said table one by one;

a cut sheet conveying mechanism in said cut sheet conveying section, for receiving and temporarily stopping the cut sheet fed from said cut sheet feed mechanism, conveying that cut sheet to a predetermined position in said conveying section and stopping and holding the cut sheet at said predetermined position; and control means for operating said cut sheet feed mechanism prior to a trailing edge of a preceding sheet passing by said predetermined position, for causing said cut sheet conveying mechanism to receive and temporarily stop a next cut sheet after the trailing edge of the preceding sheet departs the cut sheet conveying mechanism, and for causing said cut sheet conveying mechanism to feed the next sheet to said predetermined position after the next sheet is temporarily stopped thereby.

2. A unit according to claim 1, wherein said cut sheet conveying section is projected from and swingably supported by a main body of said unit.

3. A unit according to claim 2, wherein said cut sheet conveying section is provided at its end with roller means which is urged to said feeding means.

4. A unit according to claim 3, wherein said cut sheet conveying section is provided with means cooperative with said sheet receiving portion to urge the roller means to said feeding means.

5. A paper feed apparatus as defined in claim 1, wherein said paper feeding mechanism stops immediately after a cut sheet is fed.

6. A paper feed unit cooperable with an image forming apparatus, comprising:

a table for supporting thereon a stack of cut sheets;

a cut sheet conveying section adapted to be set to a sheet receiving portion formed in the image forming apparatus and adapted to cooperate with a feeding means of the image forming apparatus;

a cut sheet feed mechanism for feeding the cut sheets from the stack on said table one by one;

a cut sheet conveying mechanism in said cut sheet conveying section, for receiving and temporarily stopping the cut sheet fed from said cut sheet feed mechanism, conveying that cut sheet to a predetermined position in said conveying section and stopping and holding the cut sheet at said predetermined position; and cut sheet sensors spaced away from each other along the path of cut sheets in said cut sheet conveying section for operating said cut sheet feeding mechanism and said cut sheet conveying mechanism in such association with each other that when an upstream sensor detects the cut sheet, said cut sheet feeding mechanism operates to feed the next sheet to said cut sheet conveying mechanism which temporarily stops the next sheet and when a downstream sensor detects the preceding cut sheet, said cut sheet conveying mechanism operates to convey the cut sheet to the predetermined position and stops and then holds the fed cut sheet in said cut sheet conveying section.

7. A paper feed unit cooperable with an image forming apparatus, comprising:

a table for supporting thereon a stack of cut sheets;

a cut sheet conveying section adapted to be set to a sheet receiving portion formed in the image forming apparatus and adapted to cooperate with a feeding means of the image forming apparatus;

a cut sheet feed mechanism for feeding the cut sheets from the stack on said table one by one;

a cut sheet conveying mechanism, in said cut sheet conveying section, for receiving and temporarily stopping the cut sheet fed from said cut sheet feed mechanism, conveying that cut sheet to a predetermined position in said conveying section and stopping and holding the cut sheet at said predetermined position; and a first sensor, disposed on the path of conveyed cut sheets, for actuating said cut sheet feed mechanism to generate a signal instructing the feeding of a single cut sheet of the stack when the trailing edge of the first mentioned cut sheet is sensed by said first sensor;

a second sensor, disposed downstream of said first sensor along the path of conveyed cut sheets, for actuating said cut sheet conveying mechanism to generate a signal instructing the conveying of that fed cut sheet to said cut sheet conveying section when the trailing edge of the first cut sheet is sensed by said second sensor; and a counter actuated by said second sensor when the leading edge of the cut sheet fed by said cut sheet conveying mechanism is sensed by said second sensor, said counter being effective to stop said cut sheet conveying mechanism after a predetermined time interval to stop and hold the cut sheet at said predetermined position.

* * * * *

UNITED STATES PATENT AND TRADEMARK OFFICE

CERTIFICATE OF CORRECTION

PATENT NO. : 4,838,534 Sheet 1 of 4

DATED : June 13, 1989

INVENTOR(S) : TADASHI ISHIKAWA, ET AL.

It is certified that error appears in the above-identified patent and that said Letters Patent is hereby corrected as shown below:

Cover Page,

[56], "4,639,959" should read --4,369,959--;

[57], line 14, "once" should read --temporarily--.

Figure 24A:
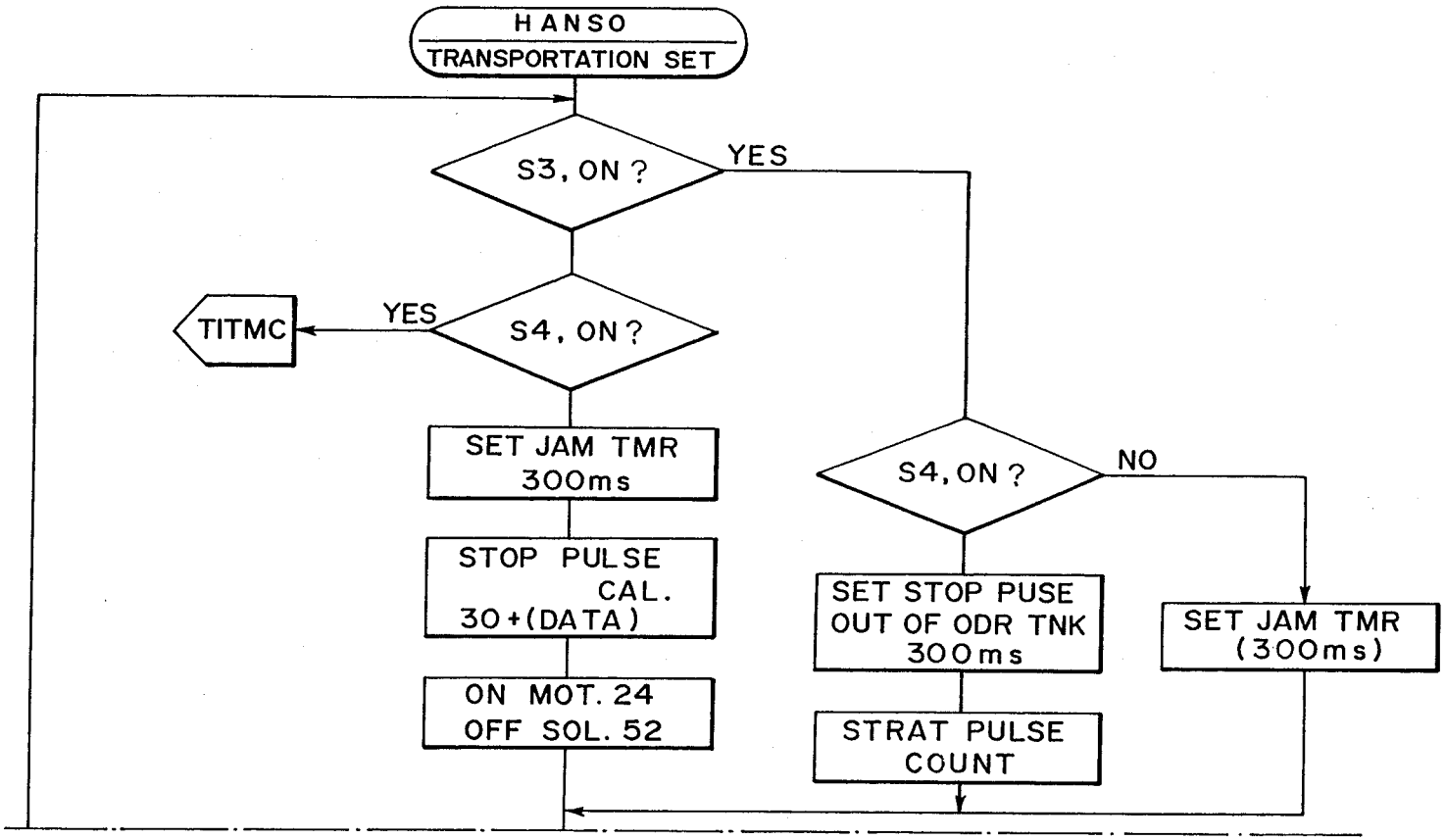
FIGS. 24A and 24B is a flow chart of the operation of the paper feeding, conveying and holding mechanism.
Figure 24B:
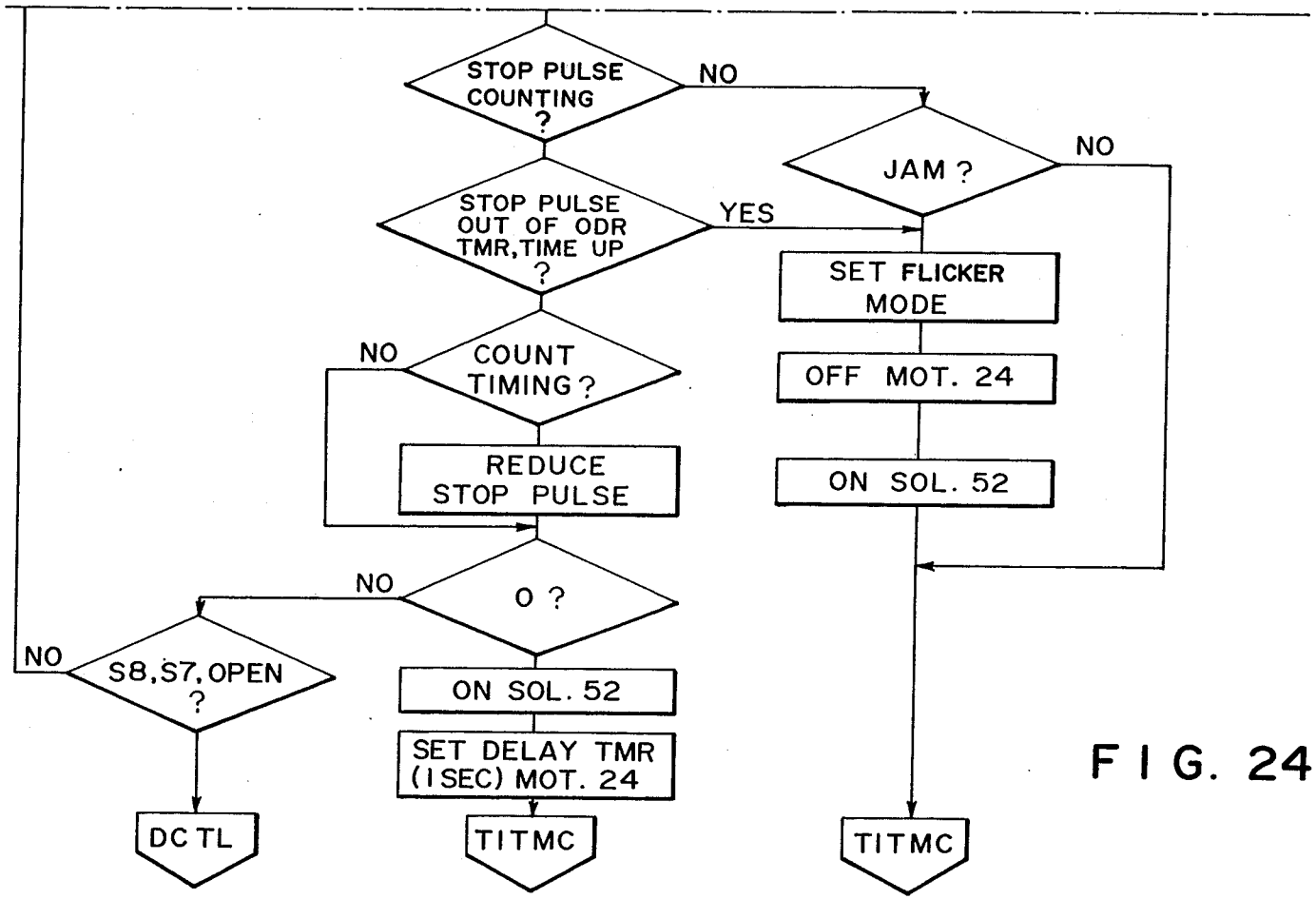

In The Drawing,

Sheet 21, Fig. 24A, "STRAT PULSE COUNT" should read --START PULSE COUNT--.

Column 1, line 18, "papercontaining" should read --paper-containing--;

line 52, "is" should read --it--; same line, "an other" should read --another--;

line 57, "an" should read --a--.

Column 3, line 2, "cut-sheets" should read --cut sheets--;

line 17, "forming" should read --image forming--.

Column 5, line 60, "extention 117" should read --extension 117--.

Column 6, line 2, "rail 13" should read --rail 113--.

UNITED STATES PATENT AND TRADEMARK OFFICE

CERTIFICATE OF CORRECTION

PATENT NO. : 4,838,534

DATED : June 13, 1989

INVENTOR(S) : TADASHI ISHIKAWA, ET AL.

It is certified that error appears in the above-identified patent and that said Letters Patent is hereby corrected as shown below:

Column 7, line 1, "to" should read --out--.

Column 9, line 41, "20" should read --22--;

line 47, "IF" should read --If--.

Column 10, line 58, "ints" should read --its--.

Column 11, line 61, "is" should read --are--.

Column 12, line 15, "47" should read --57--;

line 16, "49" should read --59--;

line 21, "47" should read --57--.

Column 15, line 22, "stype" should read --style--;

line 45, "stype" should read --style--;

line 47, "stype" should read --style--;

line 64, "adjustable" should read --adjustably--.

UNITED STATES PATENT AND TRADEMARK OFFICE

CERTIFICATE OF CORRECTION

PATENT NO. : 4,838,534

DATED : June 13, 1989

INVENTOR(S) : TADASHI ISHIKAWA, ET AL.

It is certified that error appears in the above-identified patent and that said Letters Patent is hereby corrected as shown below:

Column 16, line 52, "The" should read --In--.

Column 17, line 23, "in" should be deleted;

line 25, "relayed" should read --remains--.

Column 18, line 20, "in" should read --is--.

Column 19, line 31, "where" should read --the--;

line 34, "fitst" should read --first--.

Column 20, line 50, "rotated" should read --rotate--.

Column 23, line 12, "coincide" should read --coincident--;

line 18, "coincide" should read --coincident--;

line 27, "be" should read --will be--; same line, "frm" should read --from--;

line 51, "driven" should read --drive--.

UNITED STATES PATENT AND TRADEMARK OFFICE

CERTIFICATE OF CORRECTION

PATENT NO. : 4,838,534 Sheet 4 of 4

DATED : June 13, 1989

INVENTOR(S) : TADASHI ISHIKAWA, ET AL.

It is certified that error appears in the above-identified patent and that said Letters Patent is hereby corrected as shown below:

Column 24, line 37, "apparatus" should read --unit--.

Signed and Sealed this

Eighth Day of May, 1990

*Attest:*

HARRY F. MANBECK, JR.

*Attesting Officer*

*Commissioner of Patents and Trademarks*